US006629441B2

(12) United States Patent
Lavergne

(10) Patent No.: US 6,629,441 B2
(45) Date of Patent: Oct. 7, 2003

(54) DOOR UNLOCKING SYSTEM

(76) Inventor: Jean-Guy Lavergne, 105, Lemoyne East App. 11, Longueuil, Quebec (CA), J4H 1V1

( * ) Notice: Subject to any disclaimer, the term of this patent is extended or adjusted under 35 U.S.C. 154(b) by 0 days.

(21) Appl. No.: 09/900,173

(22) Filed: Jul. 9, 2001

(65) Prior Publication Data

US 2002/0069684 A1 Jun. 13, 2002

(30) Foreign Application Priority Data

Oct. 20, 2000 (CA) ..... 2323996

(51) Int. Cl.[7] ..... E05B 49/00

(52) U.S. Cl. ..... 70/278.3; 70/107; 70/110; 70/277

(58) Field of Search ..... 70/277, 278.1–278.3, 70/278.7, 107–110, 279.1–283.1

(56) References Cited

U.S. PATENT DOCUMENTS

| | | | | |
|---|---|---|---|---|
| 3,266,276 A | * | 8/1966 | Yulkowski | 70/110 |
| 4,276,760 A | | 7/1981 | Nolin | 70/107 |
| 6,196,035 B1 | | 3/2001 | Tsui | 70/107 |
| 6,241,295 B1 | | 6/2001 | Hoogendoorn | 292/348 |

* cited by examiner

*Primary Examiner*—Suzanne Dino Barrett

(57) ABSTRACT

A door unlocking system may be used as an add-on for a door lock; the door lock being mounted in a door comprising a door frame and a door latching bolt. The system allows the door to be unlocked and opened using only one hand. The system also allows for the door to be opened with a key, through a remote signal, and to be unlocked until it is relocked.

12 Claims, 38 Drawing Sheets

DOOR UNLOCKING SYSTEM

FIELD OF THE INVENTION

The present invention relates to a door unlocking device or system to be used as an add-on to a door latch mechanism. The door unlocking system engages the latching bolt of the door latch mechanism and retracting it thereby opening the door. The latching bolt then automatically returns to extended door locking position when the handle is released.

BACKGROUND OF THE INVENTION

Door locking devices are known for locking doors and are quite common. One specific subclass of door unlocking devices which has come into use is door locking devices which automatically relock themselves after the door has been opened. These devices are especially useful for apartment buildings and other places which are open to many people, but not to the general public.

In these devices it is known to provide a pivoted push plate which, when pushed, retracts the latching bolt and opens the door from the inside of a building. From the outside, a separate key inserted in a lock barrel is used to unlock the door. This simultaneously requires the use of one hand to keep the key turned 180 degrees in the lock barrel to engage the latching bolt in the unlocked position, and the use of the other hand to open the door by pulling a handle. This known system may be difficult to use by disabled or handicapped people, as well as the elderly or people carrying parcels and the like in their hands.

SUMMARY OF THE INVENTION

Therefore in one aspect the invention provides for A door unlocking system for use with a door combination comprising a door, a door enclosure border, and a door locking means, said door being displaceable between an open and a closed position, said door locking means comprising a lock barrel means, a female element and a latch bolt means comprising a male member, said lock barrel means being displaceable between an inactive configuration and an active configuration, said door comprising said latch bolt means, said door enclosure border comprising said female element, said male member and said female element being disposed and configured such that said male member is displaceable between an extended position wherein said female element is able to receive the male member for locking said door in said closed position and a retracted position wherein said male member is retracted from said female member so that said door is displaceable from said closed position to said open position, said latch bolt means comprising bolt biassing means for biassing the male member in said extended position, the door unlocking system comprising:

a door grasping means displaceable between a first non-working position and a second actuation position, door grasp biassing means biassing the door grasping means in said first non-working position, pusher means operatively connected to said door grasping means;

an intermediate engagement means;

a reset biassing means;

a retractor means operatively connected to the intermediate engagement means;

retractor biassing means;

connector means for operatively connecting said lock barrel means to said intermediate engagement means; and connector biassing means; and connector retaining means;

said retractor means being displaceable between a first retractor position and a second retractor position such that when the retractor means is displaced from said first retractor position to said second retractor position the retractor means engages the latch bolt means and urges the displacement of the male member from said extended position to said retracted position, and when the retractor means is displaced from said second retractor position to said first retractor position the retractor means disengages the male member such that the bolt biassing means displaces the male member to said extended position;

said retractor biassing means biassing the retractor means in said first retractor position;

said intermediate engagement means being displaceable between a first engagement position, wherein the pusher means is able to engage the intermediate engagement means such that said intermediate engagement means may be urged thereby to induce the retractor means to be displaced from said first retractor position to said second retractor position, and a second neutral position wherein the pusher means is unable to engage the intermediate engagement means;

said reset biassing means biassing the intermediate engagement means in the second neutral position;

said connector retaining means being displaceable between a retaining position and a non-retaining position;

said connector means being displaceable between an engagement configuration in which the connector means engages and retains the intermediate engagement means in said first engagement position, and a disengagement configuration wherein the intermediate engagement means is in said second neutral position, being configured, such that when said lock barrel means is displaced from the inactive configuration to the active configuration, the connector means is induced to displace from said disengagement configuration to said engagement configuration, such that the intermediate engagement means is displaced from said second neutral position to said first engagement position, and said connector retaining means is induced to displace from said non-retaining position to said retaining position;

said connector retaining means being disposed such that when the connector retaining means is in said retaining position the connector retaining means retains the connector means in said engagement configuration, and such that when the connector retaining means is in said non-retaining position the connector means is free to return to said disengagement configuration;

said connector means, said door grasping means, said pusher means, and said retractor means being disposed and configured such that:

(A) when said connector means is in said engagement configuration and said door grasp means passes from said first non-working position to said second actuation position the pusher means engages said intermediate engagement means in said first engagement position so as to induce the connector retaining means to be displaced from said retaining position to said non-retaining and so as to induce the intermediate engagement means to displace the retractor means from said first retractor position to said second retractor position, and (B) when said door grasp means passes from said second actuation position to said first non-working position, the pusher means disengages the intermediate engagement means such that said reset biassing means urges said intermediate engagement means to reset to said second neutral position, thereby allowing the retractor means to return to said first retractor position.

In accordance with the present invention the connector retaining means may comprise a step on the connector means, a guide means, and a biassing means;

said step, guide means, and biassing means being disposed such that:

said biassing means gives the connector means such a bias that when the connector means is displaced from said disengagement configuration to said engagement configuration, the step is caused to move under the guide means such that the connector means cannot return to the disengagement configuration; and when said connector means is in said engagement configuration and said door grasp means passes from said first non-working position to said second actuation position the pusher means engages said intermediate engagement means in said first engagement position so as to induce the step to move out from the guide means such that the connector means may return to the disengagement configuration.

In accordance with the present invention the function of the connector biassing means may be performed by the reset biassing means.

In another aspect the present invention provides a door unlocking device or system for use with a door combination comprising a door, a door enclosure border (eg. door frame), and a door locking means, said door being displaceable (e.g. pivotable) between an open and a closed position, said door locking means comprising a lock barrel means, a female element and a latch bolt means comprising a male member, said lock barrel means being displaceable (eg. rotatable) between an inactive configuration and an active configuration, said door comprising said latch bolt means, said door enclosure border comprising said female element, said male member and said female element being disposed and configured such that said male member is displaceable between an extended position wherein said female element is able to receive the male member for locking said door in said closed position and a retracted position wherein said male member is retracted from said female member so that said door is displaceable from said closed position to said open position, said latch bolt means comprising bolt biassing means for biassing the male member in said extended position, the door unlocking system or device comprising:

a door grasping means (eg. handle, knob, etc.) displaceable between a first non-working position and a second actuation position, door grasp biassing means biassing the door grasping means in said first non-working position, pusher means operatively connected to said door grasping means;

an intermediate engagement means;

system biassing means comprising a first biassing component, a second biassing component, and a third biassing component;

a retractor means operatively connected to the intermediate engagement means;

connector means operatively connected to said lock barrel means; and connector retaining means displaceable between a retaining position and a non-retaining position;

said retractor means being displaceable between a first retractor position and a second retractor position such that when the retractor means is displaced from said first retractor position to said second retractor position the retractor means engages the latch bolt means and urges the displacement of the male member from said extended position to said retracted position, and when the retractor means is displaced from said second retractor position to said first retractor position the retractor means disengages the male member such that the bolt biassing means displaces the male member to said extended position;

said intermediate engagement means being displaceable between a first engagement position, wherein the pusher means is able to engage the intermediate engagement means such that said intermediate engagement means may be urged thereby to induce the retractor means to be displaced from said first retractor position to said second retractor position, and a second neutral position wherein the pusher means is unable to engage the intermediate engagement means;

said first biassing component biassing the intermediate engagement means in the second neutral position;

said retractor means and said intermediate engagement means being disposed and configured such that when the intermediate engagement means is in said second neutral position the retractor means is in said first retractor position, and such that when the intermediate engagement means is in said first engagement position the retractor means is in said second retractor position;

said connector means being displaceable between an engagement configuration wherein the connector means engages and retains the intermediate engagement means in said first engagement position, and a disengagement configuration wherein the intermediate engagement means is in said second neutral position, said connector means being configured, such that when said lock barrel means is displaced from the inactive configuration to the active configuration, the lock barrel means displaces the connector means from said disengagement configuration to said engagement configuration, such that the intermediate engagement means induced to be displaced from said second neutral position to said first engagement position, and said connector retaining means is induced to displace from said non-retaining position to said retaining position by said second biassing component; said third biassing component biassing said connector means in said disengagement position; said connector retaining means being disposed such that when the connector retaining means is in said retaining position the connector retaining means retains the connector means in said engagement configuration, and such that when the connector retaining means is in said non-retaining position the connector means is caused to return to said disengagement configuration by said third biassing component;

said connector means, said door grasping means, said pusher means, and said retractor means being disposed and configured such that:

(A) when said connector means is in said engagement configuration and said door grasp means passes from said first non-working position to said second actuation position the pusher means engages said intermediate engagement means in said first engagement position so as to induce the connector retaining means to be displaced from said retaining position to said non-retaining and so as to induce the intermediate engagement means to displace the retractor means from said first retractor position to said second retractor position, and (B) when said door grasp means passes from said second actuation position to said first non-working position, the pusher means disengages the intermediate engagement means such that said first biassing component urges said intermediate engagement means to reset to said second neutral position, and said retractor means to reset to said first retractor position.

In accordance with the invention the door grasping means may be a handle means.

A system in accordance with the invention may further comprise:

a solenoid means;

said solenoid means comprising a plunger member operatively connected to said intermediate engagement means, said solenoid means being energizable (eg. electrically) such that when the solenoid means is in an energized state the plunger member is in a retracted position, and when the solenoid means is in a non-energized state the plunger member is in an extended position, said plunger member when said solenoid means is in said non-energized state being biassed to said extended position by a solenoid biassing means, said plunger member being disposed so as to induce displacement of said intermediate engagement means such that said intermediate engagement means may be urged thereby to induce the displacement of the male member from said extended position to said retracted position when the solenoid means changes from said non-energized state to said energized state.

A system in accordance with the invention may further comprise:

a solenoid means;

said solenoid means comprising a plunger member, said solenoid means being energizable (eg. electrically) such that when the solenoid means is in an energized state the plunger member is in a retracted position, and when the solenoid means is in a non-energized state the plunger member is in an extended position, said plunger member when said solenoid means is in said non-energized state being biassed to said extended position by a solenoid biassing means, said solenoid means being operatively connected to said connector means by said plunger member such that said connector means is configured for inducing displacement of said intermediate engagement means from said second neutral position to said first engagement position when said solenoid means changes from the non-energized configuration to the energized configuration.

The invention also allows for a system to further comprise:

a releaseable locking means;

said releasable locking means comprising a locked configuration in which the releasable locking means locks the intermediate engagement means in said first engagement position, and an unlocked configuration in which the releaseable locking means does not lock the intermediate engagement means;

said releaseable locking means, said door grasping means, said connector means, and said pusher means being disposed and configured such that (a) when said lock barrel means is in said active configuration and the connector means is inducing displacement of said intermediate engagement means from said second neutral position to said first engagement position, the door grasping means can pass from said first non-working position to said second actuation position such that the pusher means engages said intermediate engagement means so and induces said releaseable locking means to be displaced from said unlocked configuration to said locked configuration; and (b) when said intermediate engagement means is releaseably locked in said first engagement position by said releaseable locking means and said lock barrel means changes from said inactive configuration to said active configuration, said releaseable locking means is induced to be displaced from said locked position to said unlocked position such that said reset biassing means urges said intermediate engagement means to pass to said second neutral position.

In another embodiment a system may further comprise:

a solenoid means;

said solenoid means comprising a plunger member operatively connected to said intermediate engagement means, said solenoid means being energizable (eg. electrically) such that when the solenoid means is in an energized state the plunger member is in a retracted position, and when the solenoid means is in a non-energized state the plunger member is in an extended position, said plunger member when said solenoid means is in said non-energized state being biassed to said extended position by a solenoid biassing means, said plunger member being disposed so as to induce displacement of said intermediate engagement means such that said intermediate engagement means may be urged thereby to induce the displacement of the male member from said extended position to said retracted position when the solenoid means changes from said non-energized state to said energized state.

The present invention provides a door unlocking system which may have multiple advantages in that it may permit the door to be unlocked with one hand, the key to be retracted from the lock barrel and the door handle to be pulled to open the door, the door then automatically closing and relocking itself.

The system allows for the door unlocking system to be mounted on doors with small frames, the frames may for example be about 2 inches wide.

The system may be configured so as to permit door unlocking by a simple left or right quarter turn rotation of the locking key. The system may be configured to allow for the remote unlocking of the door by means of an internal plunger operated solenoid.

The system may, if desired, be adapted to existing door locking mechanisms using the existing lock barrel and keys. The system may be configured for rapid installation and to serve to reinforce the existing door locking mechanism. Properly configured only two screws may be necessary to install the system on the door.

The system may be configured to enable the key to be withdrawn from the lock barrel before the door is opened.

In accordance with the present invention a door equipped with a door unlocking system of the present invention may be unlocked with only one hand.

In accordance with the present invention a door equipped with a door unlocking system of the present invention may be set in an unlocked configuration where the door can be opened without a key until the door unlocking system is reset.

In accordance with the present invention a door equipped with a door unlocking system of the present invention may be opened through the use of an electrical signal (eg. with solenoid devices). The system may also be used in conjunction with automatic door opening devices.

Operating advantages of the present invention will become apparent by referring to the following description wherein example embodiments of the present invention are described.

In the annexed drawings, like reference characters indicate like elements throughout.

In the drawings which illustrate example embodiments of the present invention:

Figure 20:
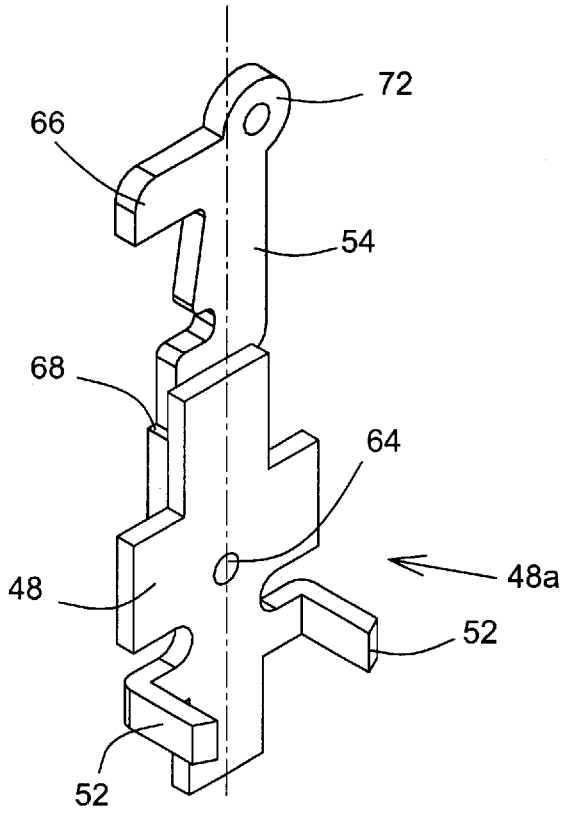
FIG. 20 is a schematic perspective view of a first example embodiment of a connector comprising a retainer member and a body member.
Figure 22:
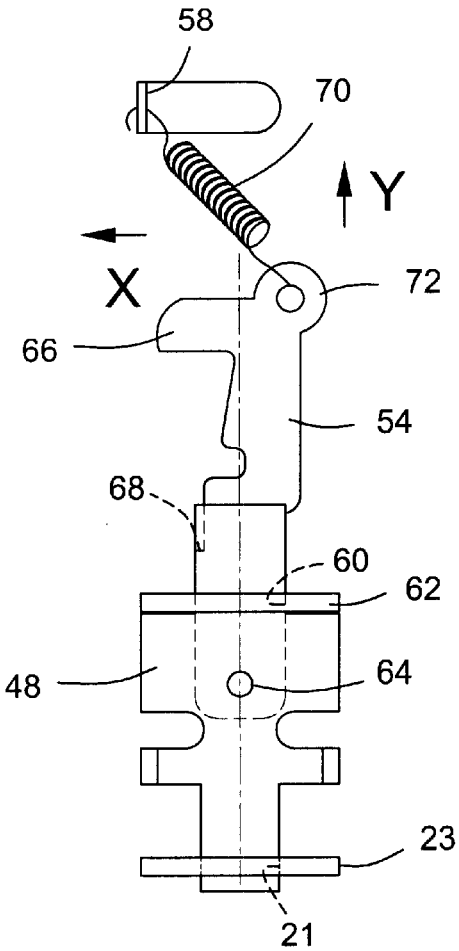
FIG. 22 shows a schematic view of the retainer member and body member of FIG. 20 when the system is in its inactive state.
Figure 22A:
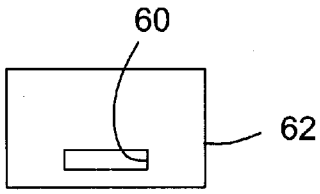

FIG. 22*a* shows a schematic top view of a guide with a guide slot for guiding the retainer member and body member of FIG. 20.

Figure 23:
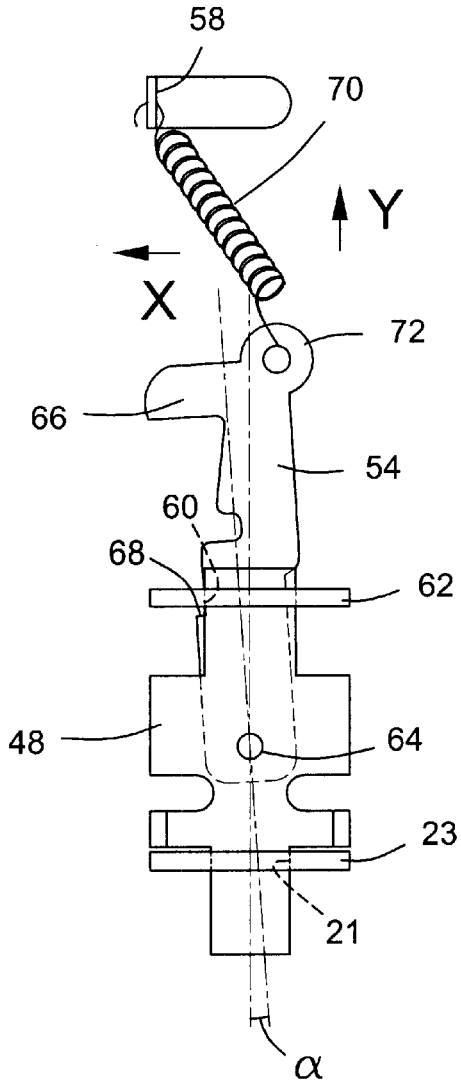
Figure 24:
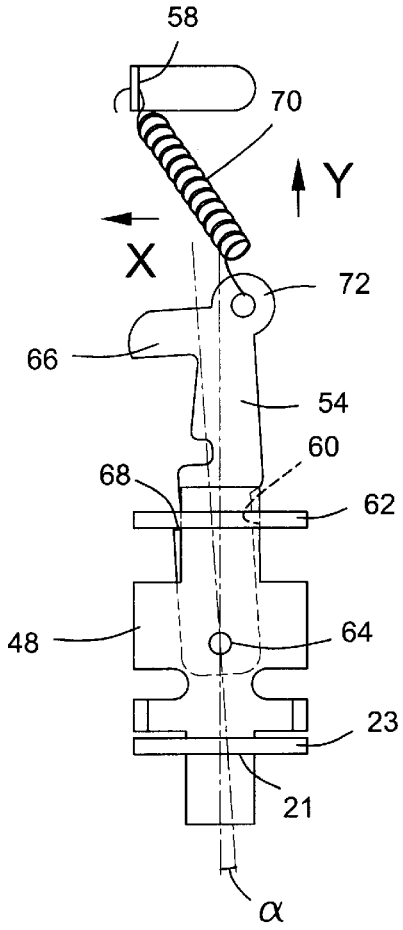
Figure 25:
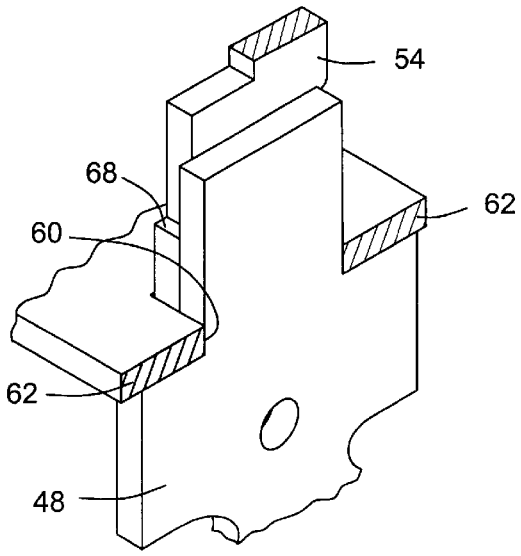
Figure 26:
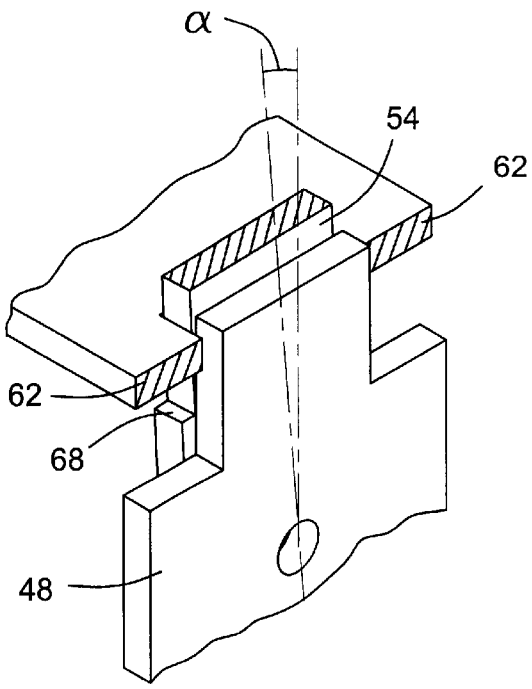
Figure 27:
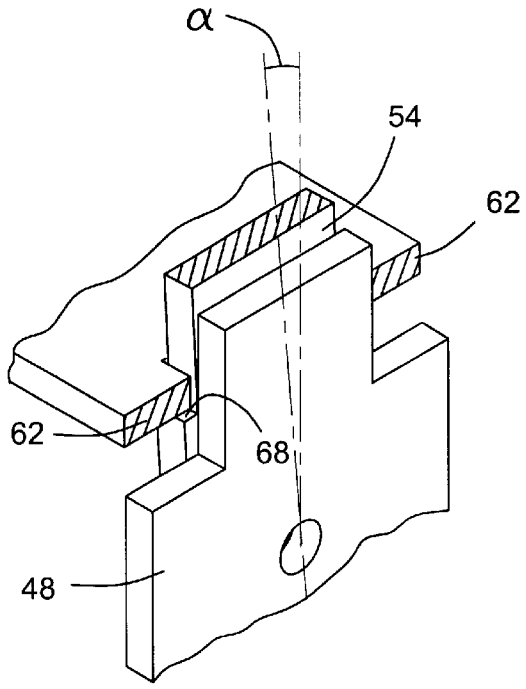
Figure 28:
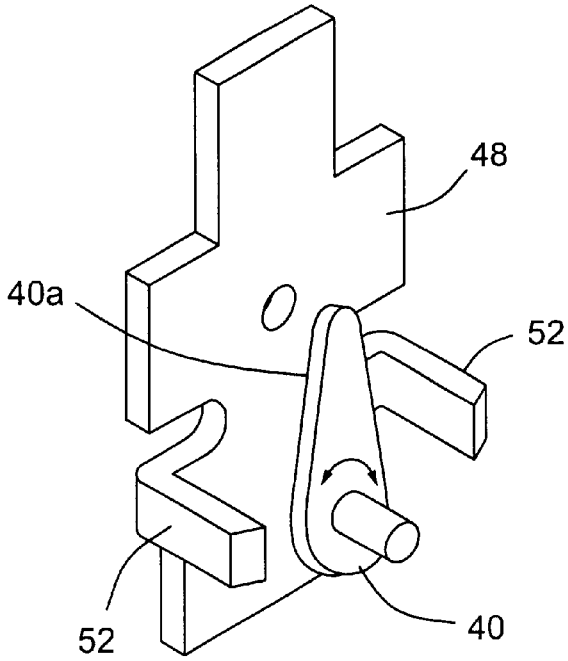
Figure 29:
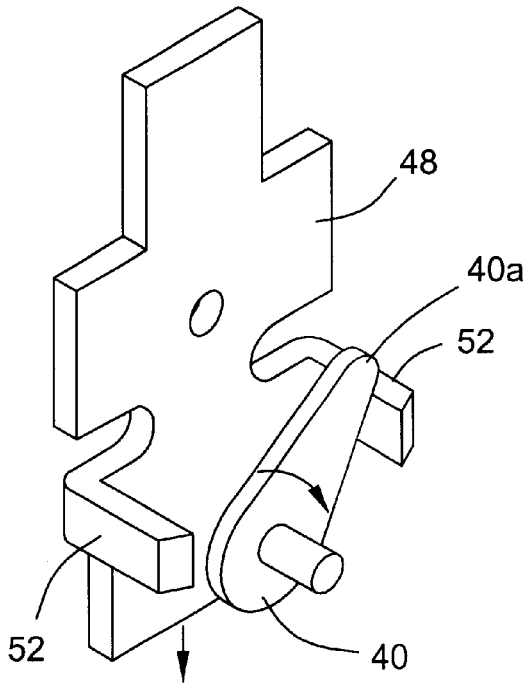
Figure 30:
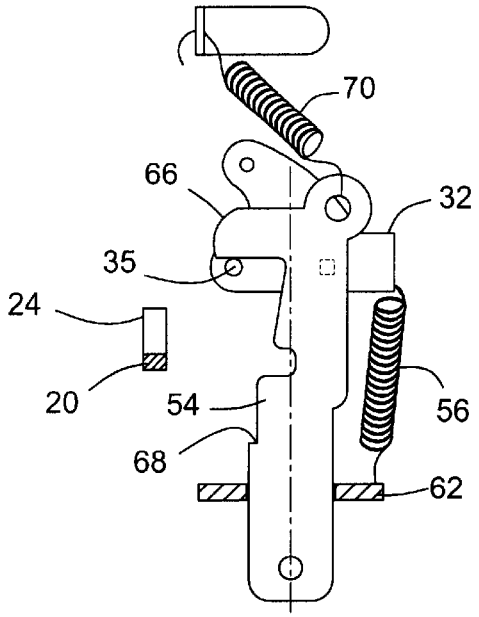
Figure 31:
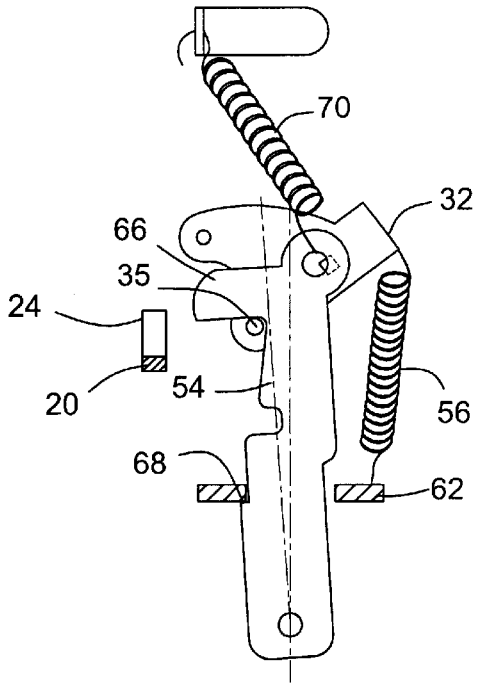
Figure 32:
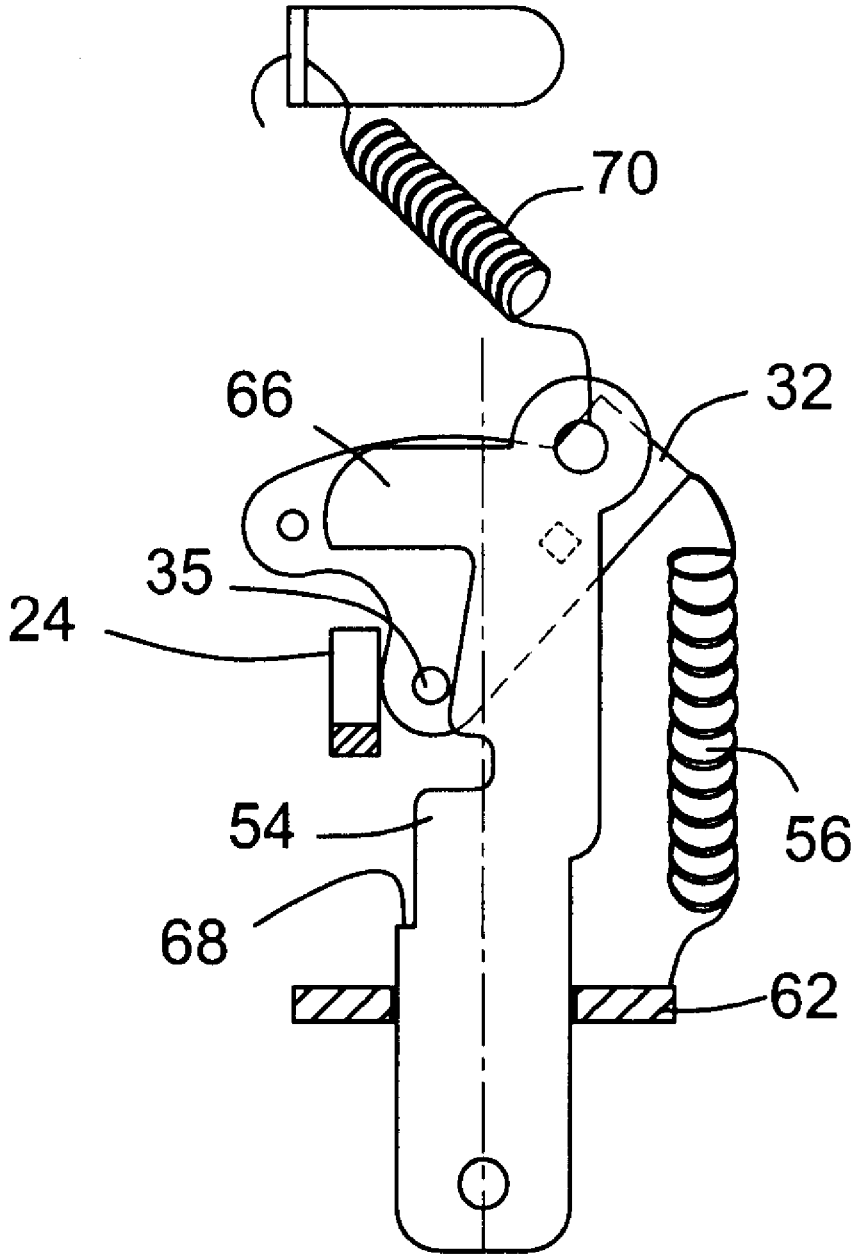
Figure 33:
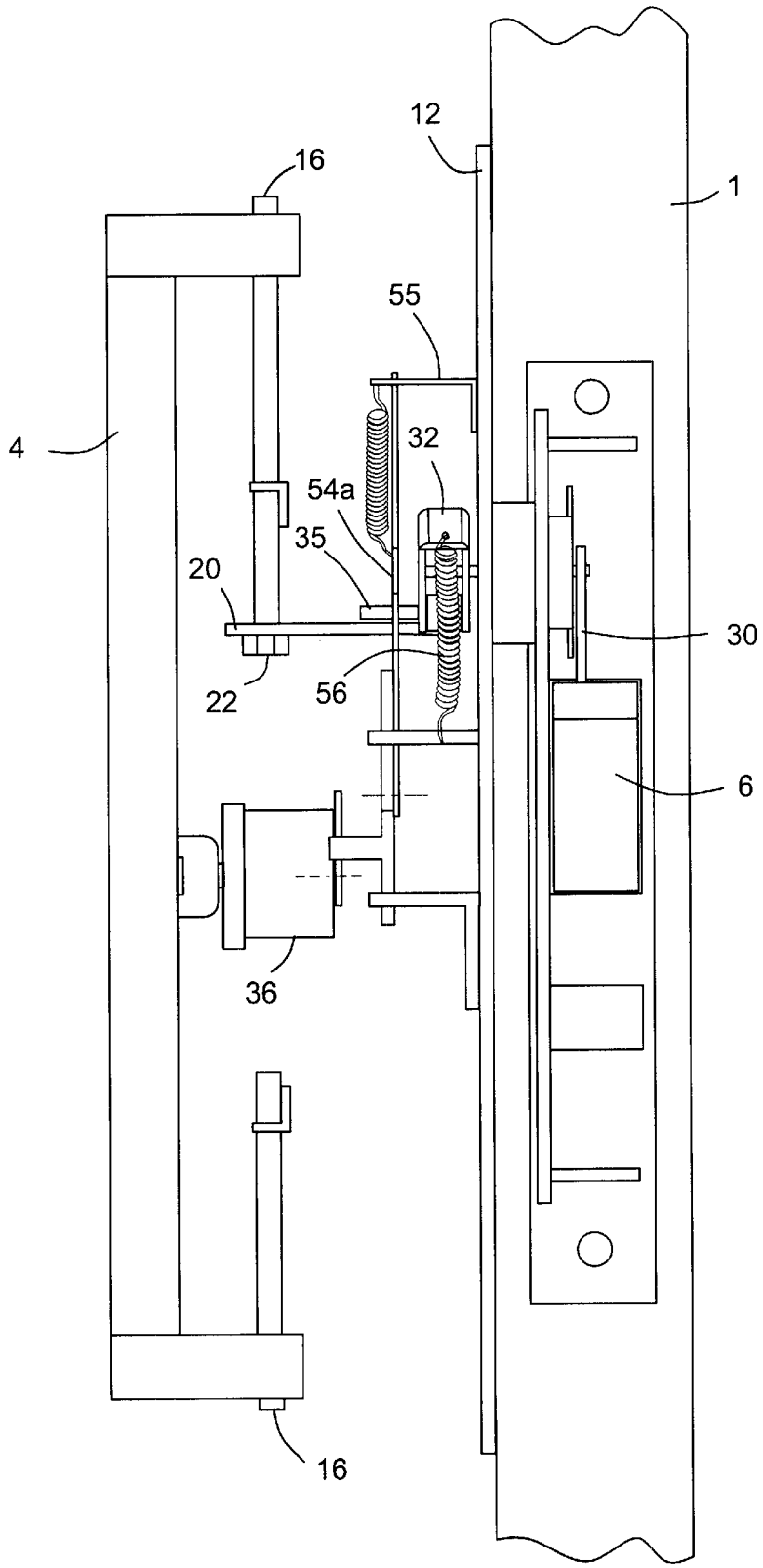
Figure 34:
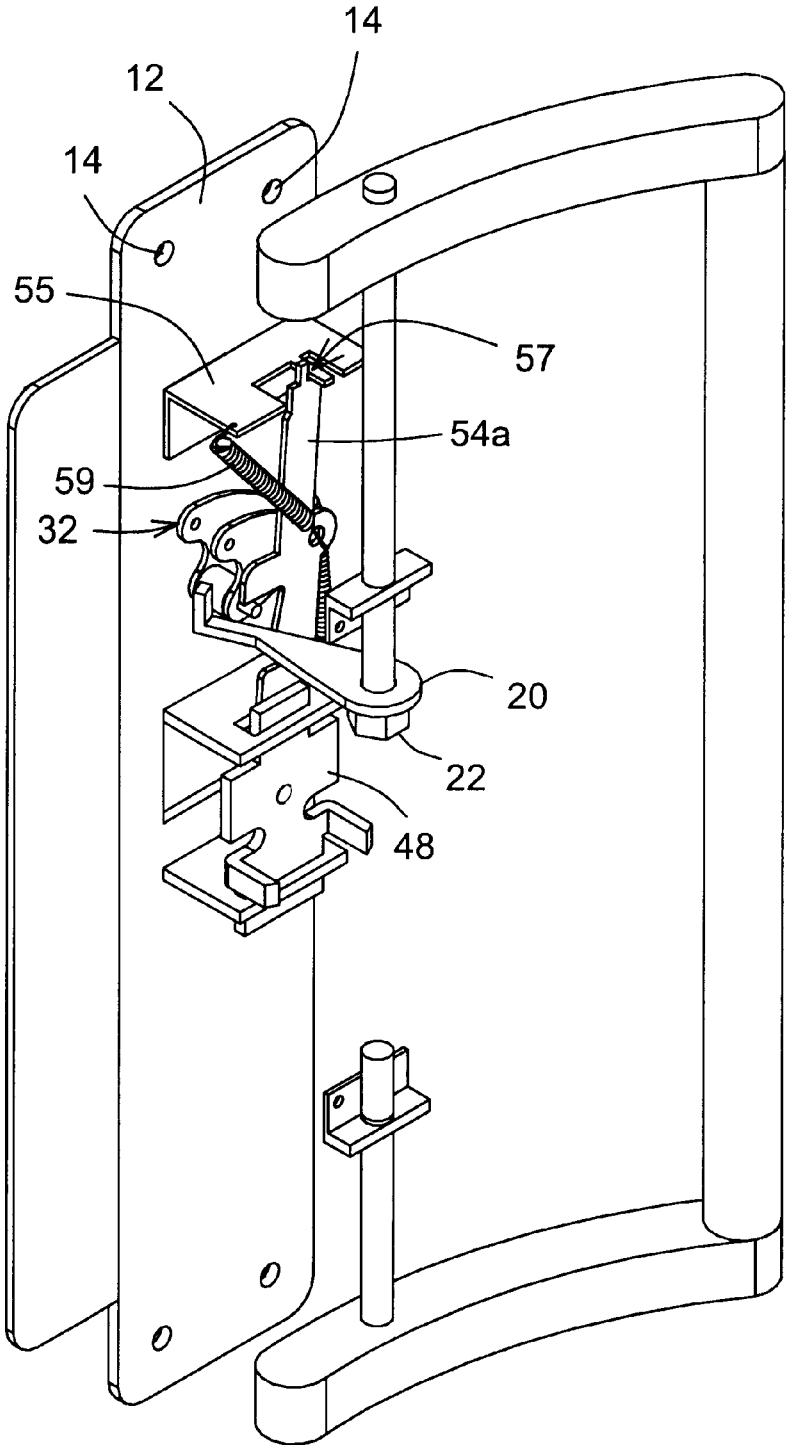
Figure 35:
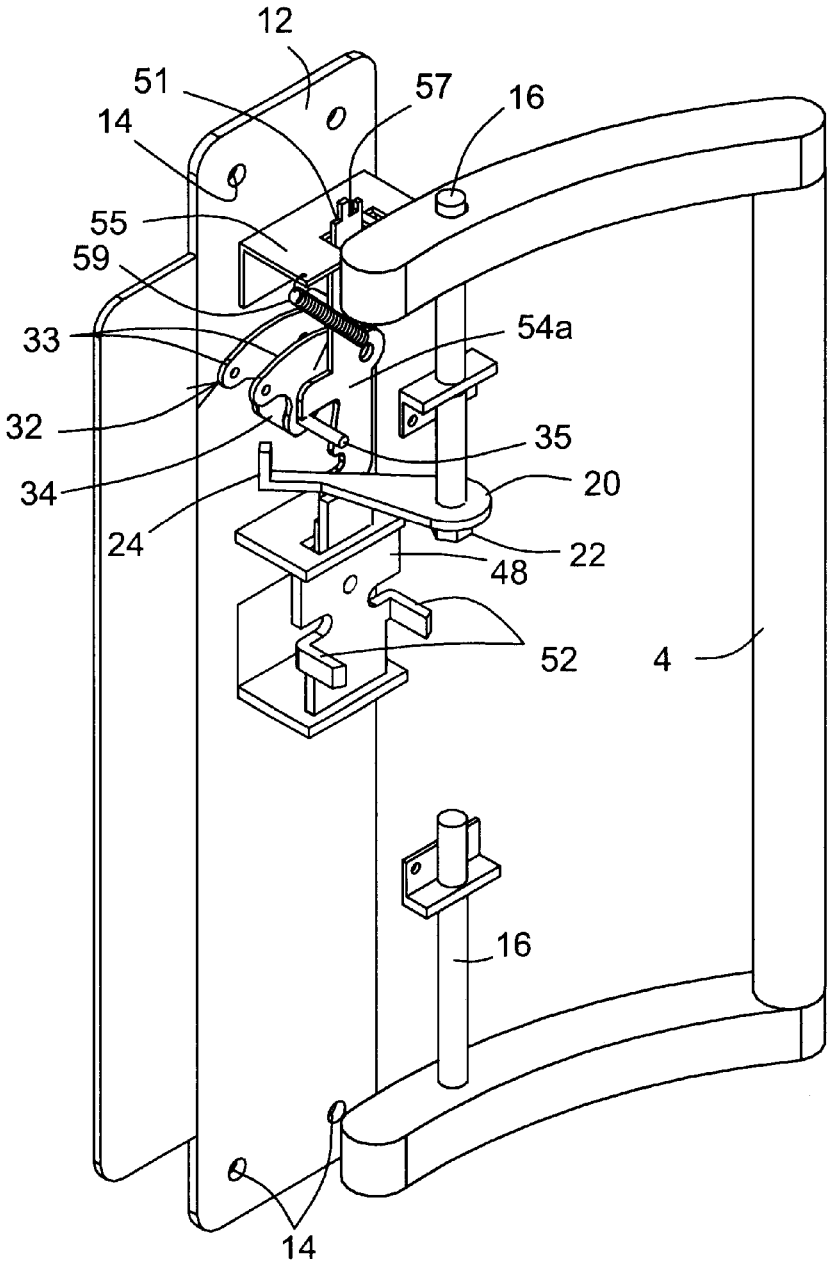
Figure 36:
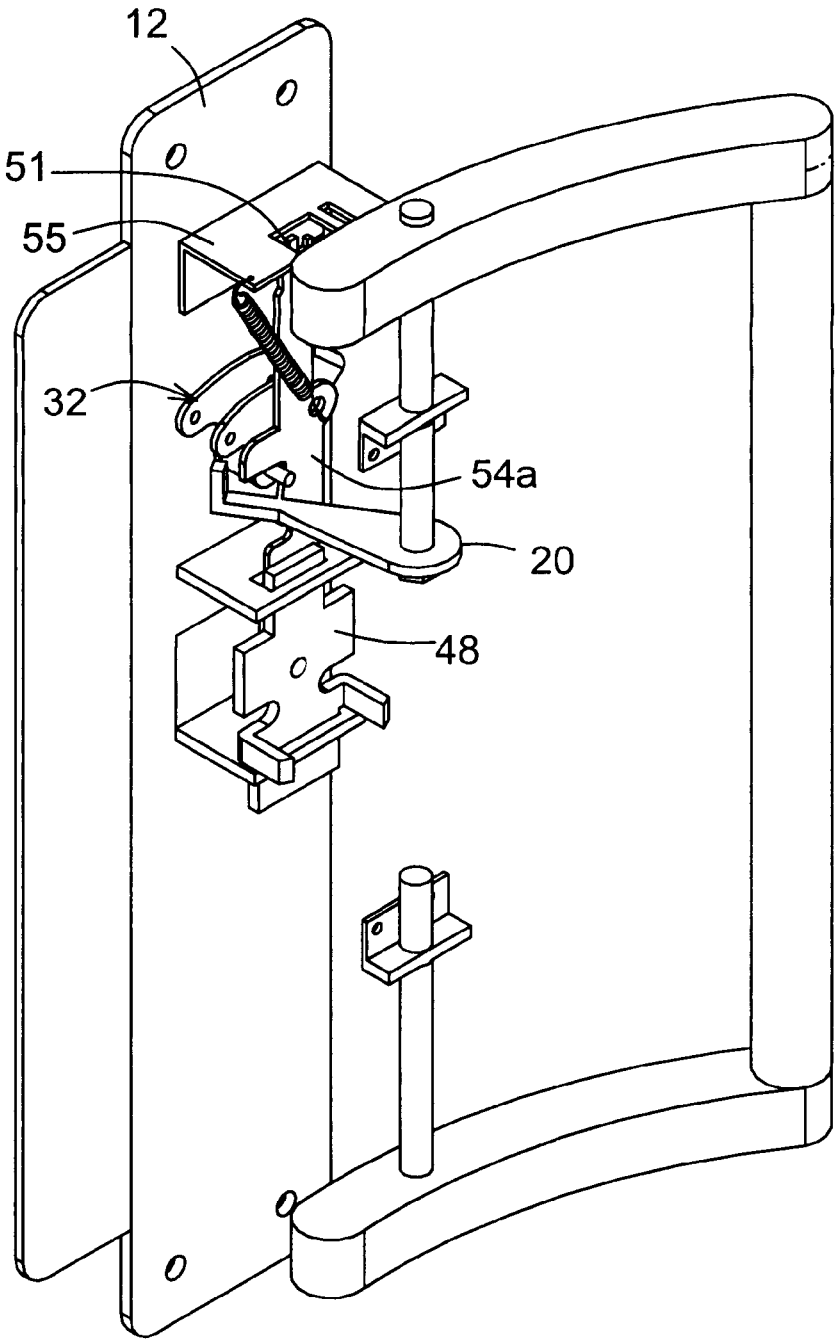
Figure 37:
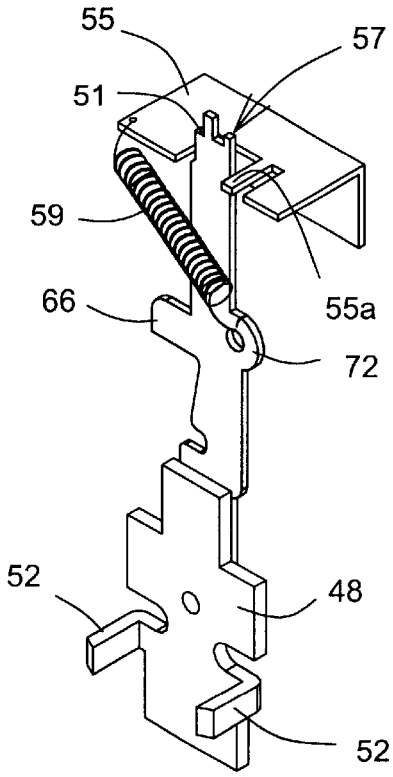
Figure 38:
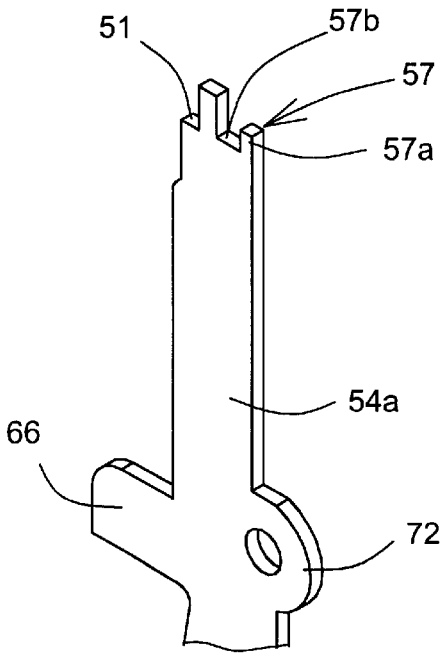
Figure 39:
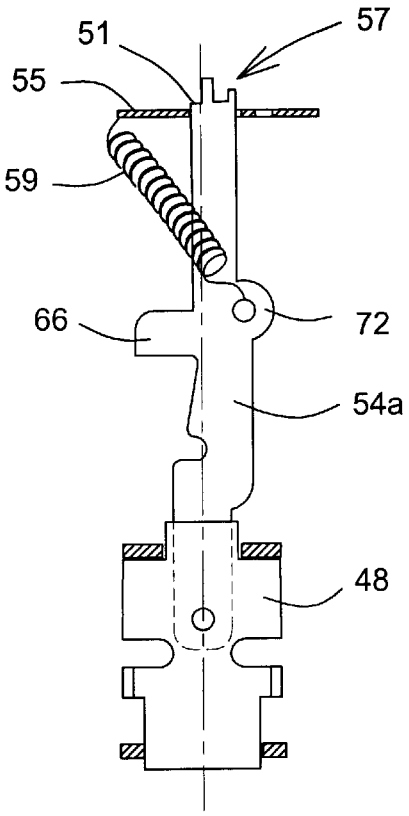
Figure 40:
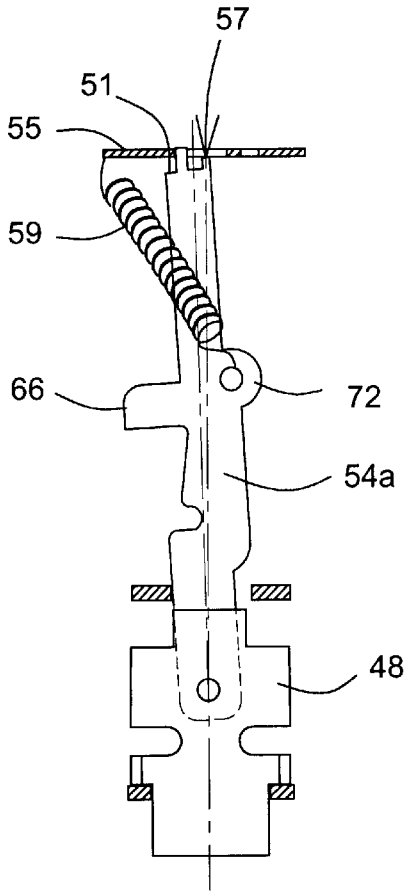
Figure 41:
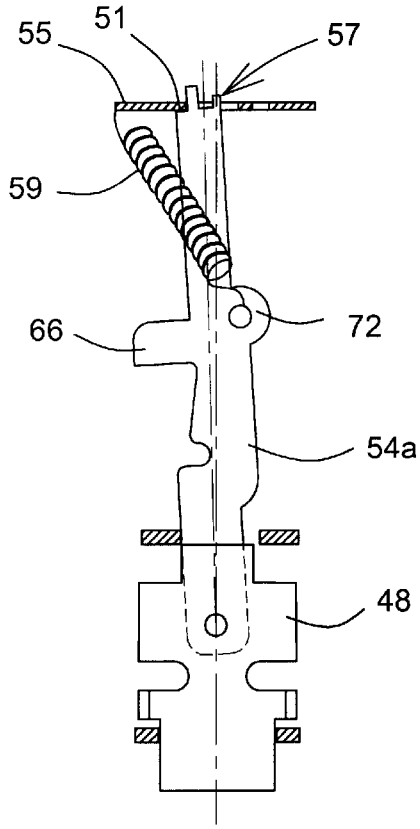
Figure 42:
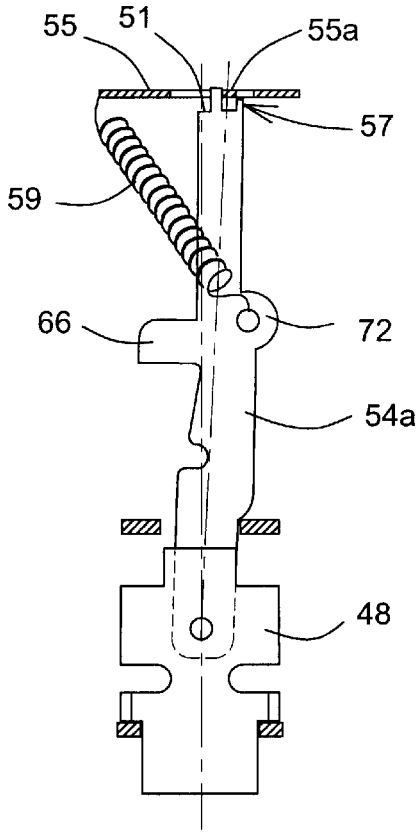
Figure 43:
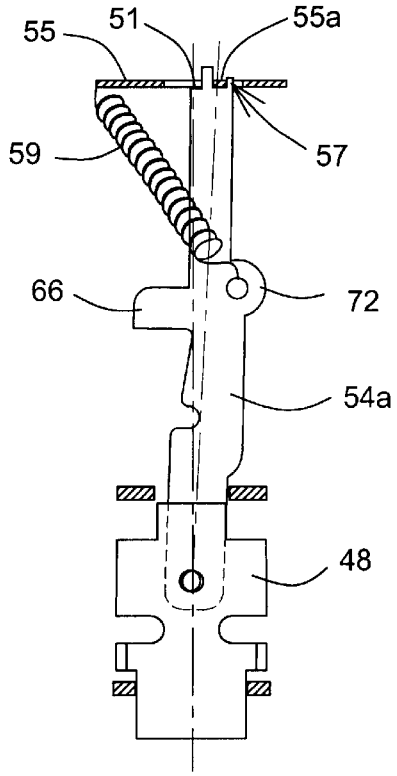
Figure 44:
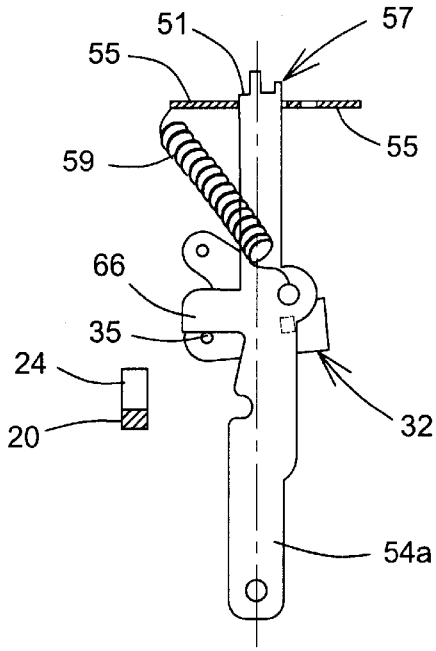
Figure 45:
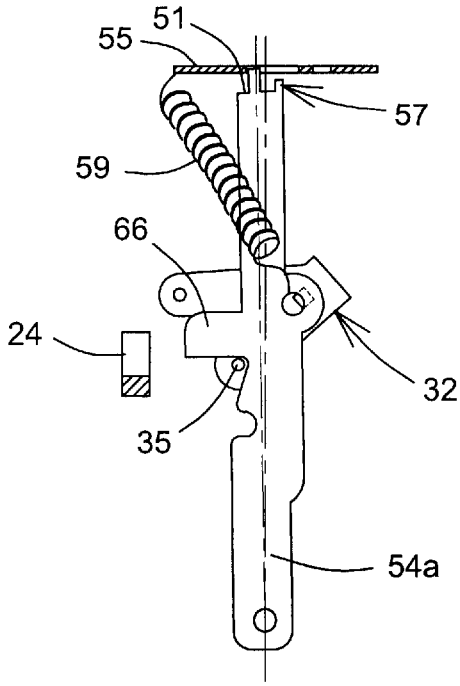
Figure 46:
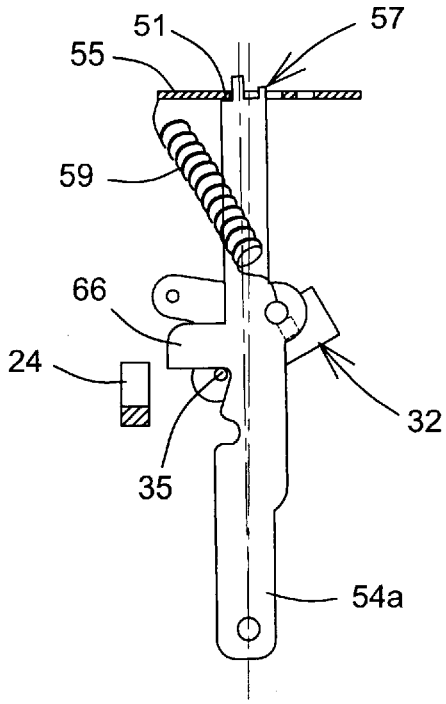
Figure 47:
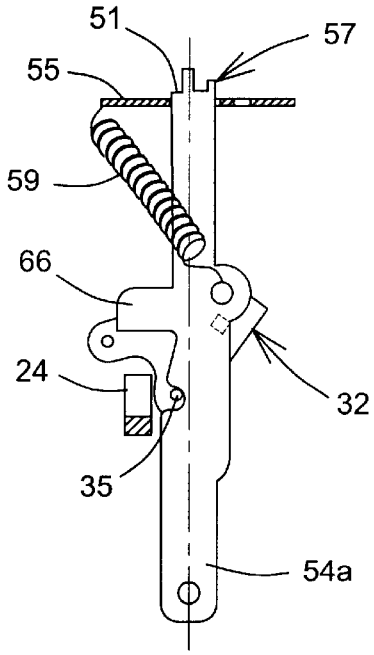
Figure 48:
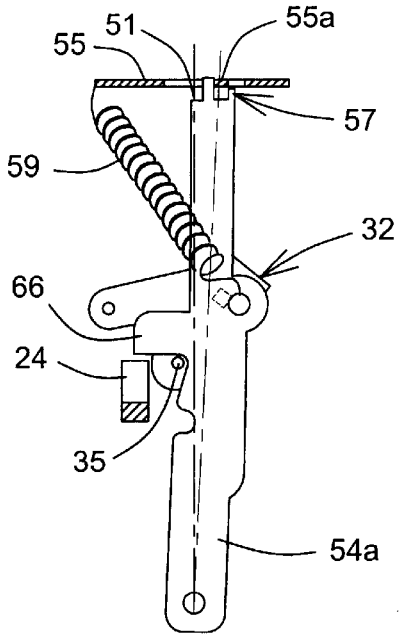
Figure 49:
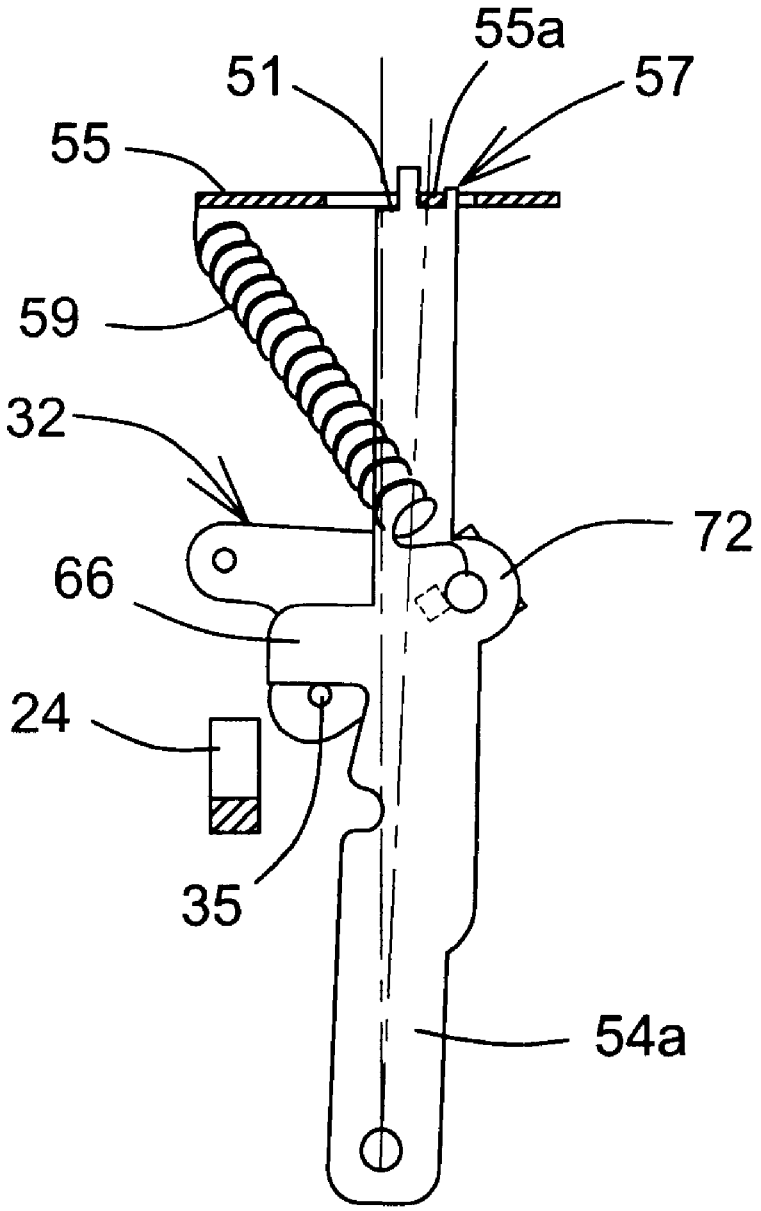
Figure 50:
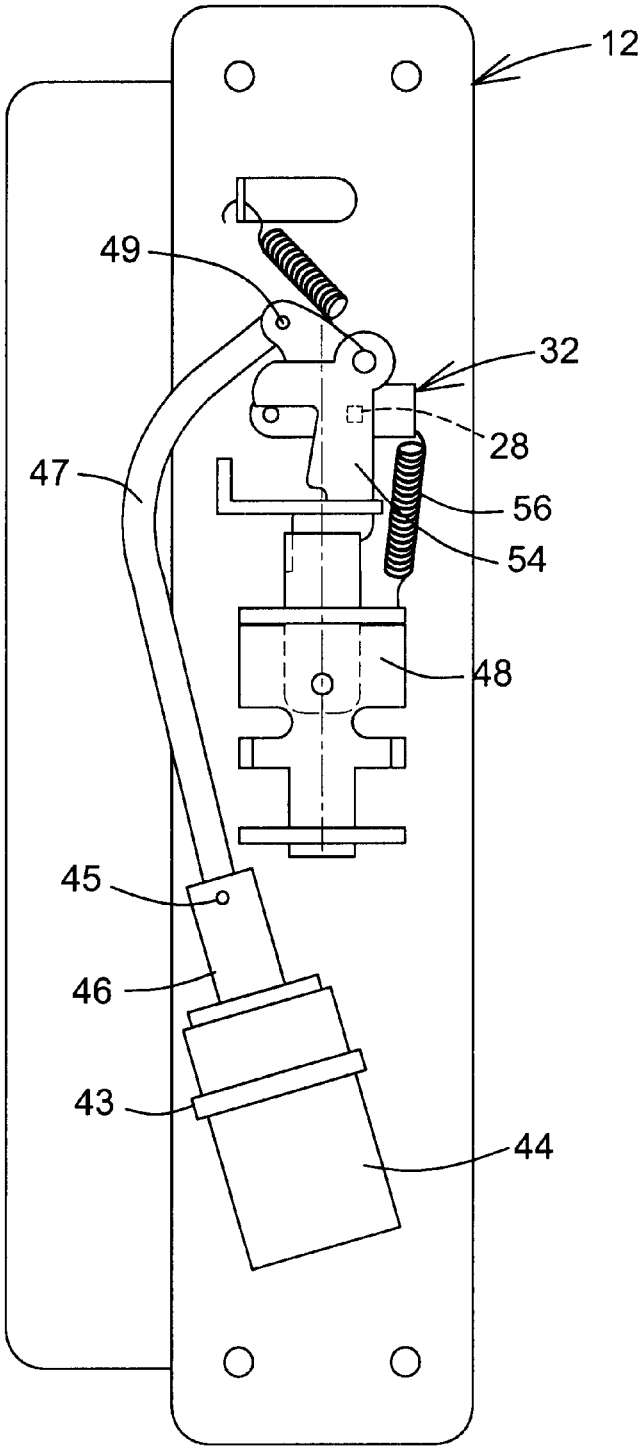
Figure 51:
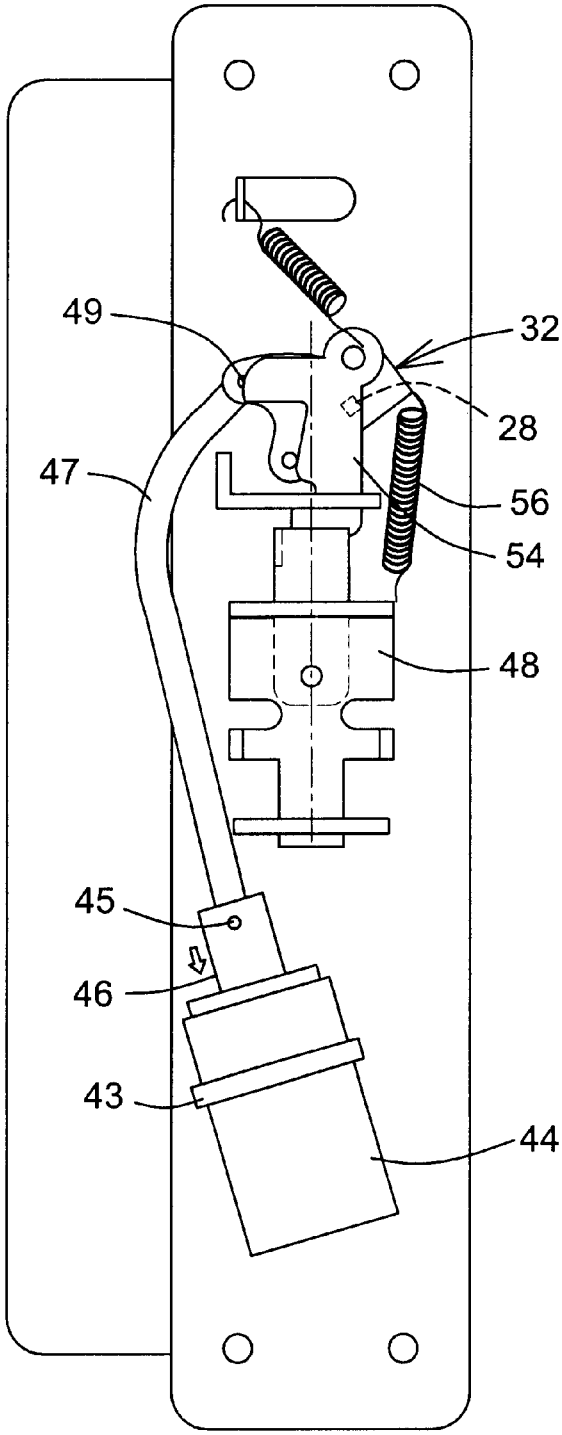
Figure 52:
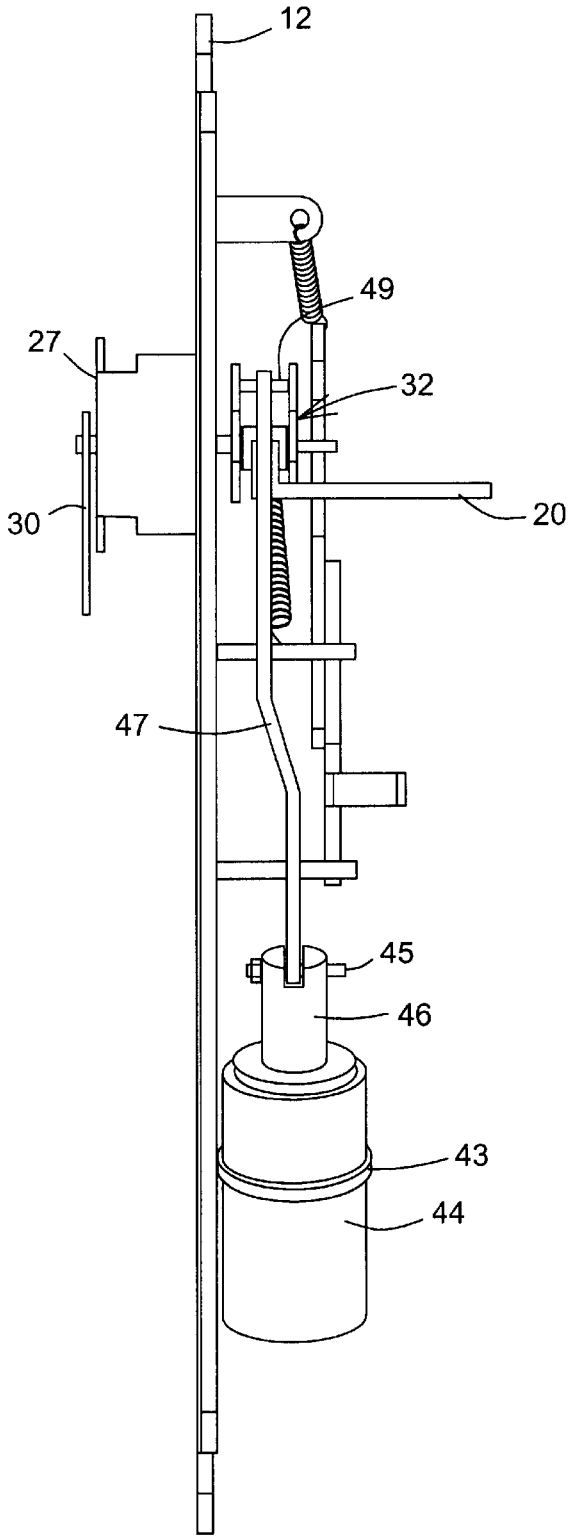
Figure 53:
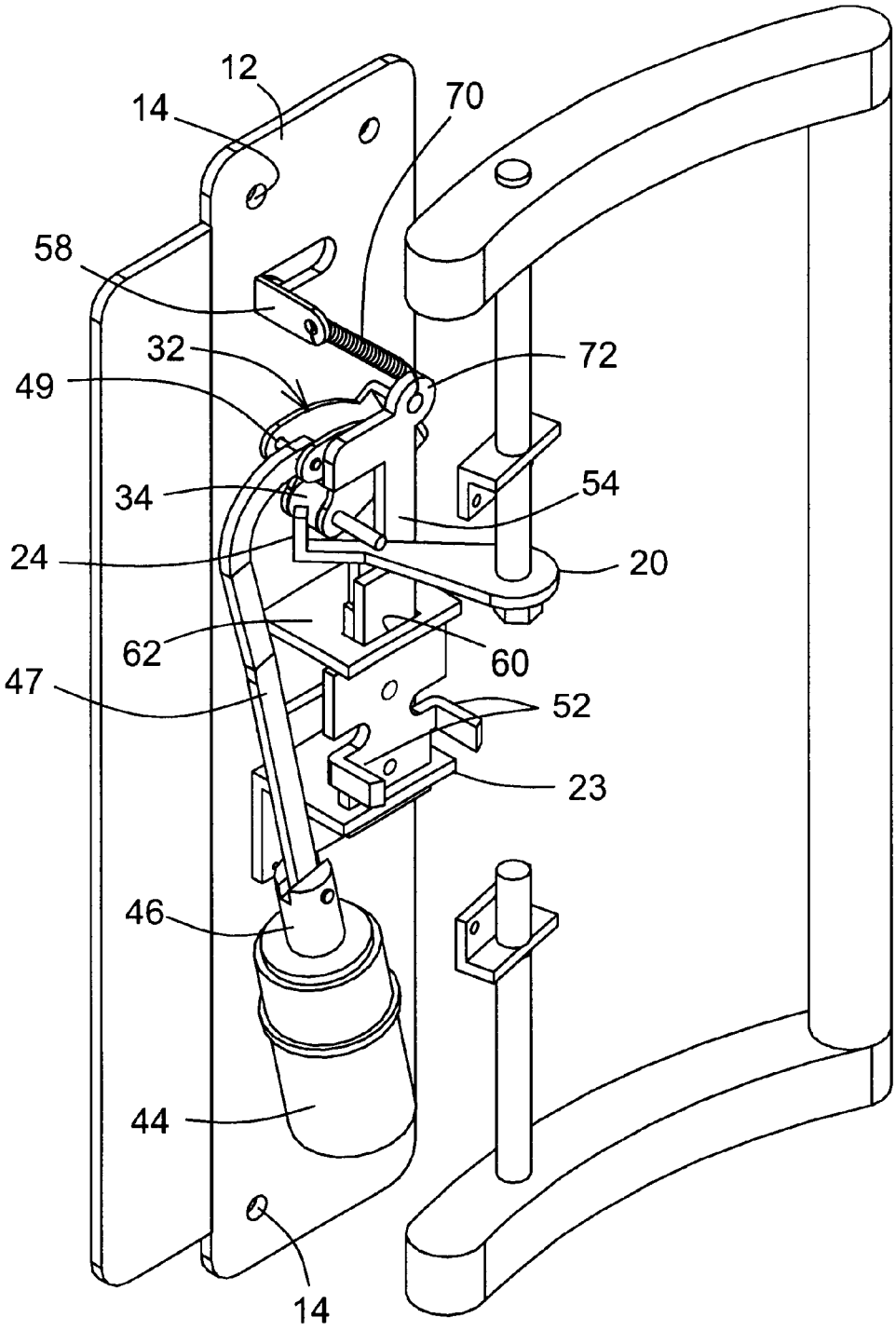
Figure 54:
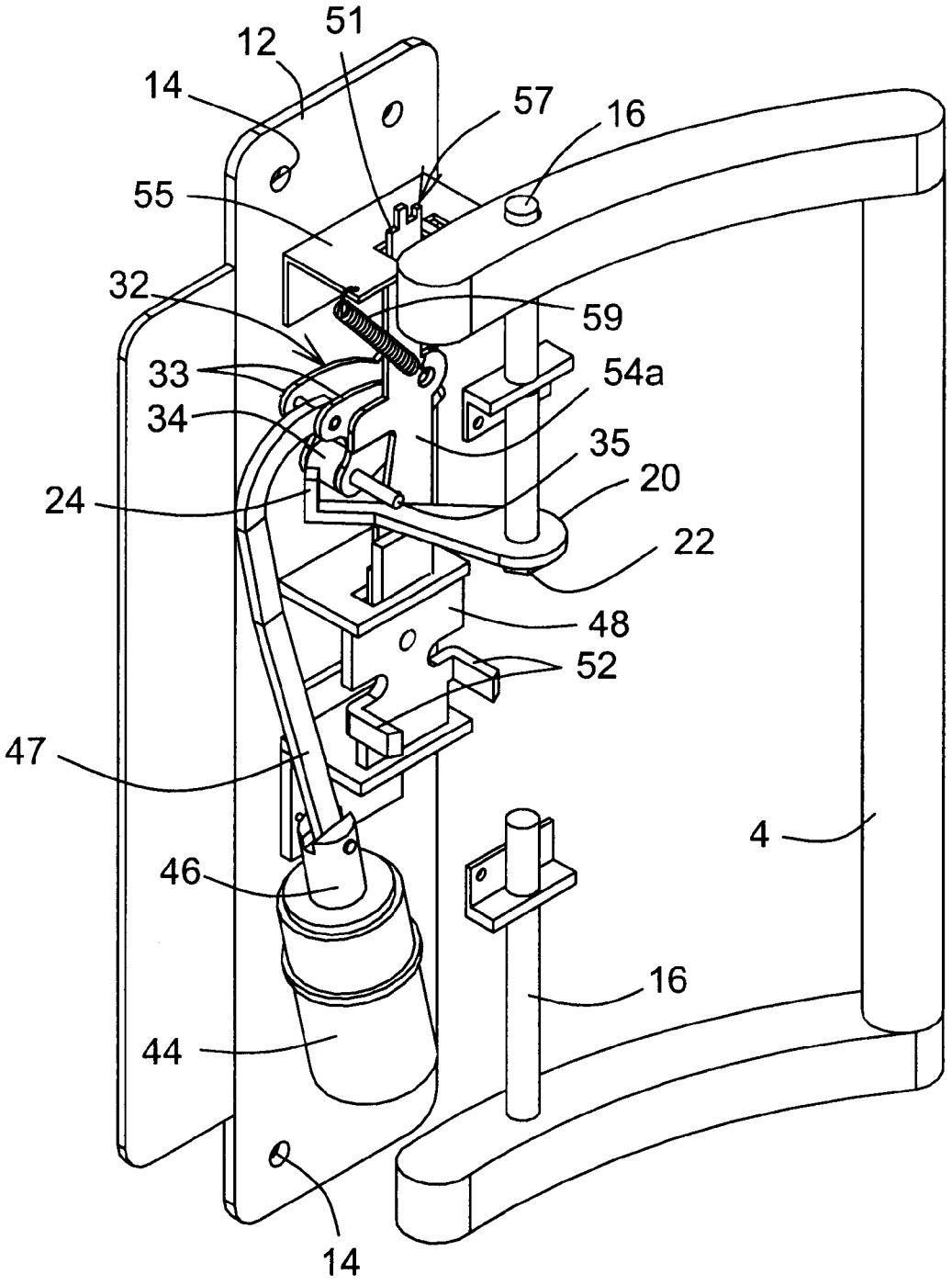
Figure 55:
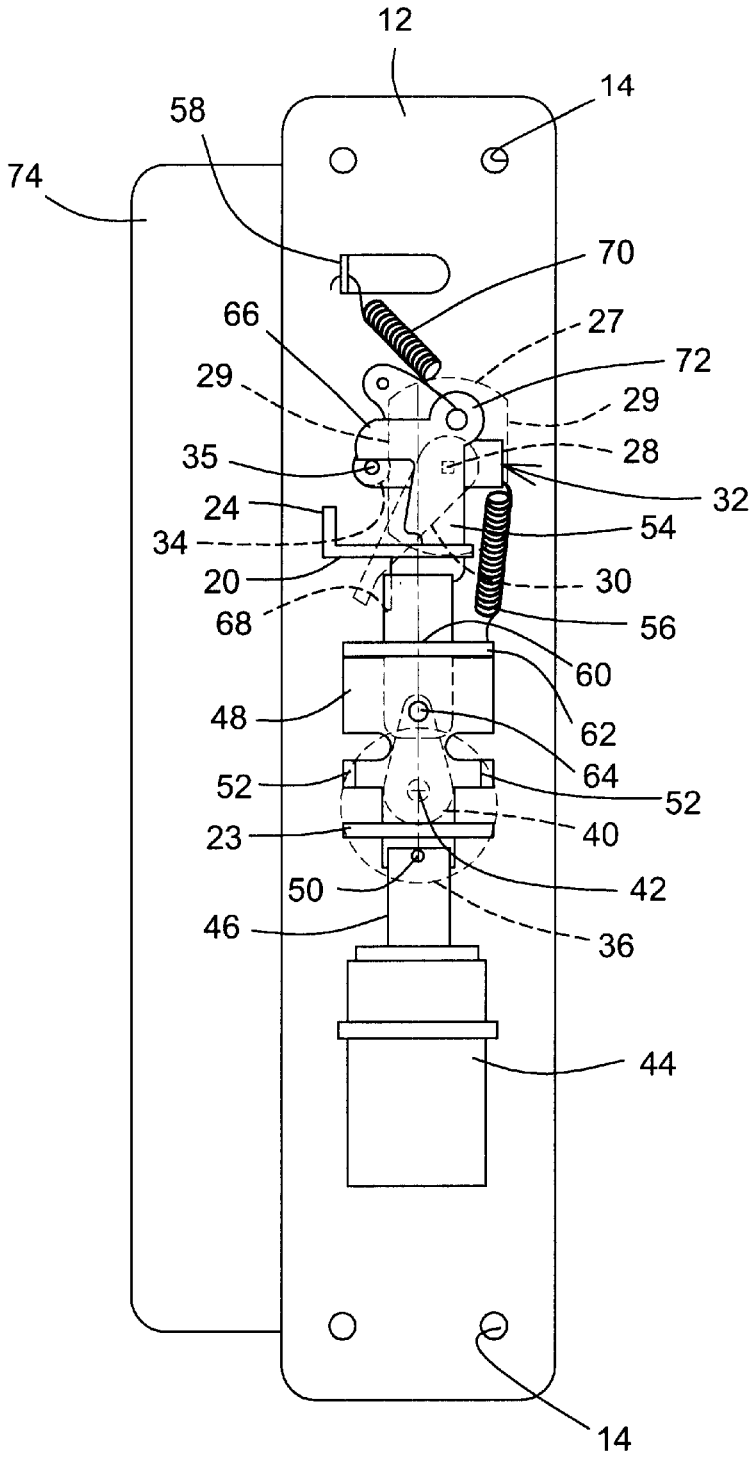
Figure 56:
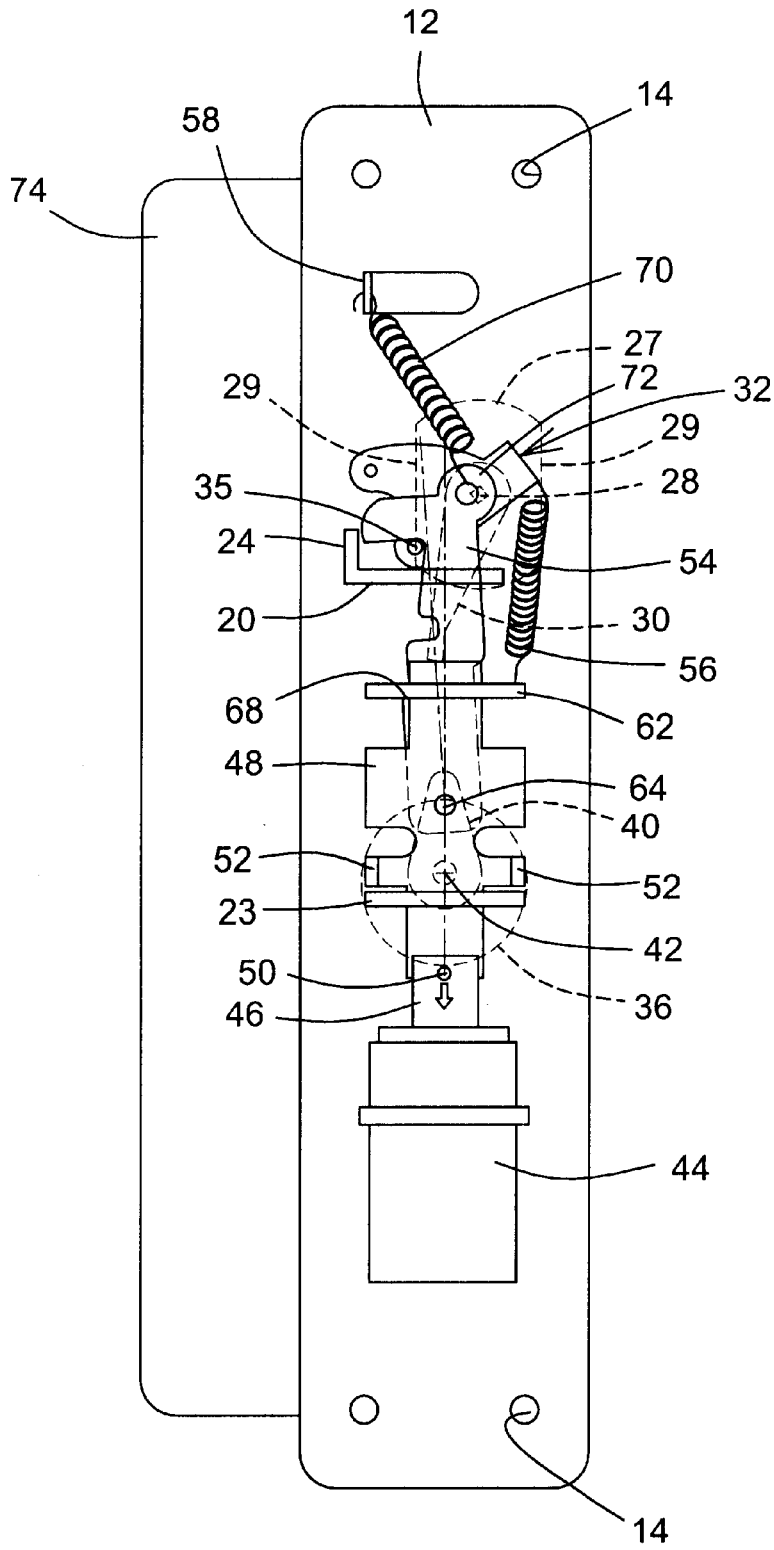
Figure 57:
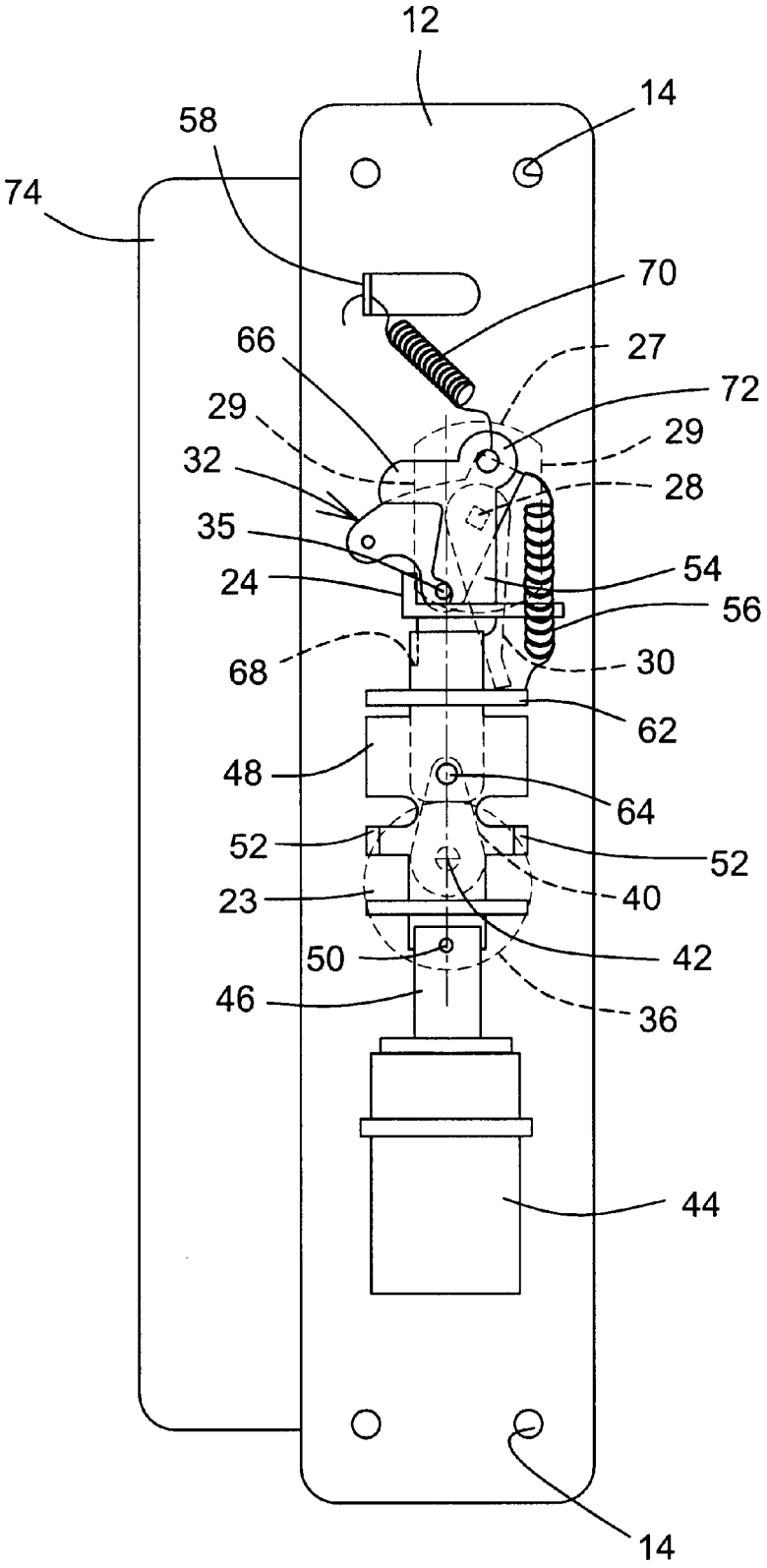

FIG. 23 shows a schematic view of the retainer member and body member of FIG. 22 as the system is being activated;

FIG. 24 show a schematic view of the retainer member and body member of FIG. 23 when the system is ready for the door to be opened;

FIG. 25 shows an enlarged schematic perspective view of central portion of the connector shown in FIG. 20, as the system is in its inactive state;

FIG. 26 shows an enlarged schematic perspective view of central portion of the connector shown in FIG. 20, as the system is being activated;

FIG. 27 shows an enlarged schematic perspective view of central portion of the connector shown in FIG. 20, as the system is ready for the door to be opened;

FIG. 28 shows a schematic perspective view of a body member of the connector of FIG. 20 and an unlocking cam of a lock barrel when the lock barrel is in an inactive configuration, with the lock barrel not shown;

FIG. 29 shows a schematic perspective view of a body member of the connector of FIG. 20 and an unlocking cam of a lock barrel when a lock barrel is in an active configuration, with the lock barrel not shown;

FIG. 30 shows a schematic view of the example retainer member of the connector shown in FIG. 20, an intermediate engagement means, and a pusher means as the system is in its inactive state;

FIG. 31 shows a schematic view of the retainer member of the connector shown in FIG. 20, the intermediate engagement means, and the pusher means of FIG. 30 as the system ready for the door to be opened;

FIG. 32 shows a schematic view of the retainer member of the connector shown in FIG. 20, the intermediate engagement means, and the pusher means of FIG. 30 as the door grasping means of the system is being pulled to open the door;

FIG. 33 shows a schematic side view of a system in accordance with the present invention provided with an second example retainer member;

FIG. 34 shows a schematic perspective view of the system of FIG. 33 with the retainer member being retained by a releasable locking means (see FIG. 43 below for more detail);

FIG. 35 shows a schematic perspective view of the system of FIG. 33, with the system in an inactive state;

FIG. 36 shows a schematic perspective view of the system of FIG. 33, with the retainer member being retained by a connector retaining means (see FIG. 41 below);

FIG. 37 shows a schematic perspective view of the example connector of FIG. 33 with retainer member and a body member;

FIG. 38 shows an enlarged schematic view of the upper portion of the retainer member of FIG. 37;

FIGS. 39, 40, and 41 show a schematic view of the retainer member and body member of FIG. 37, as the system of FIG. 33 goes from a non-working to a working state;

FIGS. 42 and 43 show a schematic view of the retainer member and body member of FIG. 39, as the system is exploiting the releasable locking means;

FIGS. 44, 45, 46, and 47 show a schematic view of the connector of FIG. 33, an intermediate engagement means and a pusher means as the system is activated, the door is unlocked, and the system resets;

FIGS. 48 and 49 show a schematic view of the connector of FIG. 33, with intermediate engagement means and pusher of FIG. 44, as the system is being used with a releasable locking means;

FIGS. 50 and 51 show a schematic view of the system fitted with a solenoid in a first example position, wherein the plunger is connected to the intermediate engagement means;

FIG. 52 shows a schematic side view of the system fitted with a solenoid in the position shown in FIG. 51;

FIG. 53 shows a schematic perspective view of the system fitted with a solenoid in the position shown in FIG. 51, comprising the connector means of FIG. 20;

FIG. 54 shows a schematic perspective view of the system fitted with a solenoid in the position shown in FIG. 51, comprising the connector means of FIG. 33; and FIGS. 55, 56, and 57 show a schematic view of a system fitted with a solenoid in a second example position, wherein the plunger is connected directly to the body member of the connector.

There now follows a description of the various parts of one example embodiment of the system. Each of these parts and their function will be described in more detail afterwards.

Figure 1:
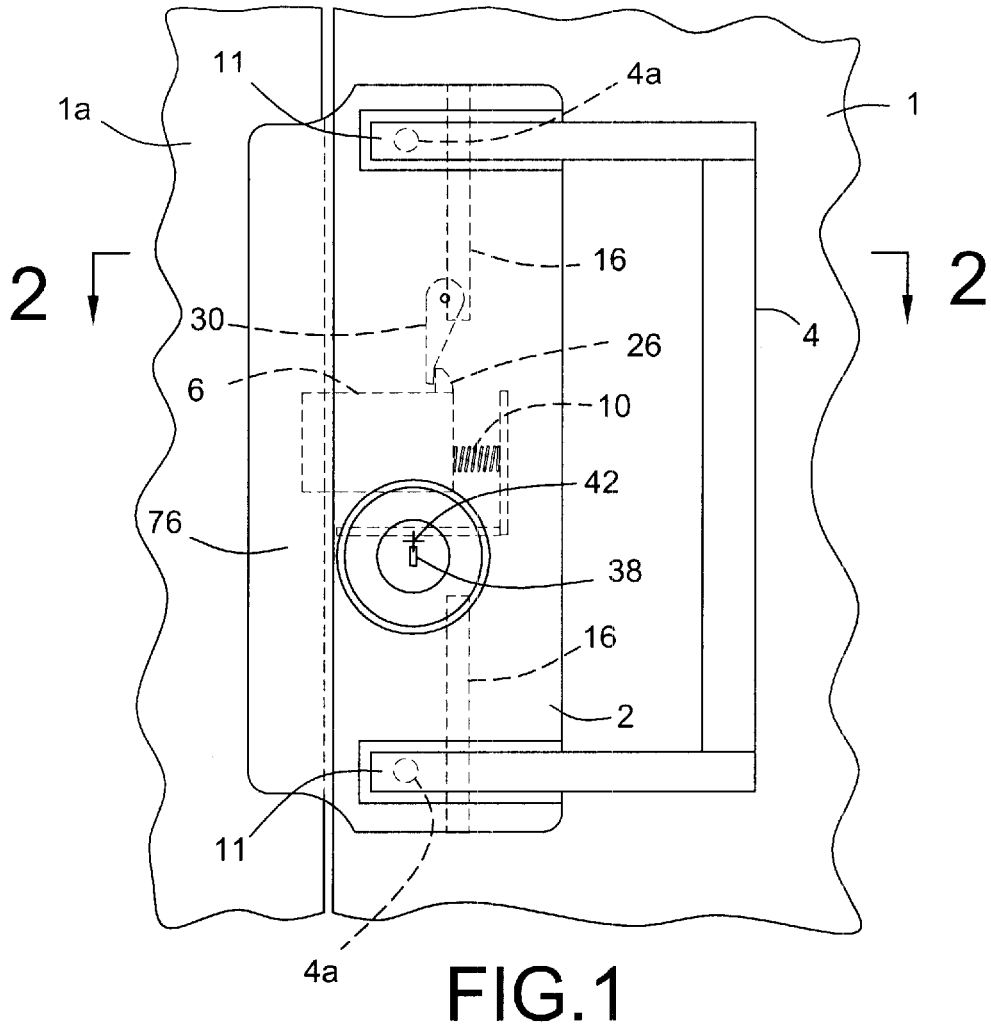
FIG. 1 is a schematic partial front view of a combination comprising a door and door frame, provided with a locking means associated with an example embodiment of the door unlocking system of the invention.
Figure 2:
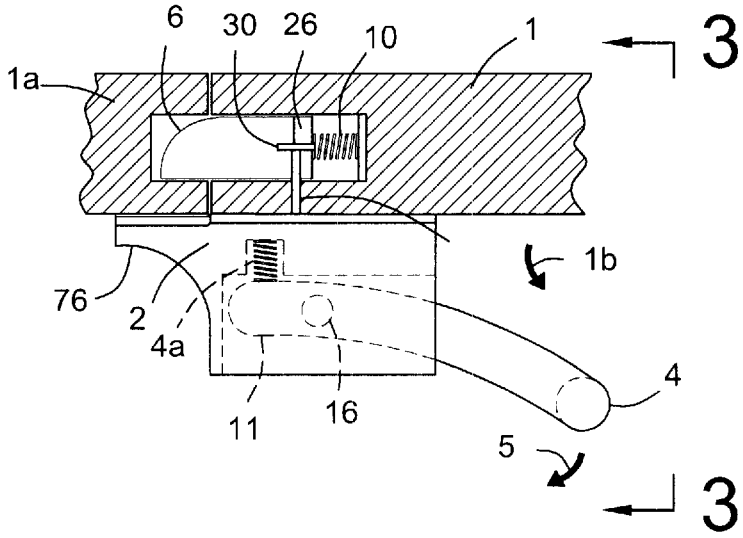
FIG. 2 is a schematic top sectional view along 2—2 of the combination shown in FIG. 1.

FIGS. 1 and 2 each show a door 1 fitted in a door enclosure border 1*a,* which in this case is embodied as a doorframe, and which opens in the direction of arrow 1*b*. The system for this embodiment is housed in a cover casing 2. A door grasping means 4 is pivotally mounted on the cover casing 2.

The door grasping means 4 is illustrated here as a handle though other equivalents such as a door knob could be used to do the same function (for function see below). The door grasping means is pivoted about the axes of a pair of pivot shafts, each of which is designated by the reference numeral 16. The top part of door grasping means 4 is secured to the upper part of the upper shaft by a retaining screw (not shown).

The door grasping means 4 has door grasp biassing means. The door grasp biassing means is in this case a compression spring 4*a*. The compression spring 4*a* is located between the cover casing 2 and the hidden extremity 11 of the door grasping means 4. The door grasp biassing means gives the door grasping means 4 a bias towards the shown first non-working position. Upon pulling of the door grasping means 4, the door grasping means 4 will move in direction of arrow 5 with respect to cover casing 2 to a second actuation position. This movement will cause the retraction of a latch bolt means 6 from the female opening, thus allowing the door to open. The retraction of the latching bolt is shown in FIGS. 6, 7, 8, and 9. The mechanics of this will be explained in more detail below. Latch bolt means has in this embodiment a bevelled face 8 and is spring loaded by a spring 10 in an extended door locking position. The spring 10 is an example of a bolt biassing means.

The cover casing 2 may be secured to door 1 using two screws (not shown). Attached to the cover casing 2 is a base support plate 12. The base support plate comprises a first side and a second side. The first side configured to lie against the cover casing 2, and the second side configured to lie against the door. The base support plate 12 has screw holes 14 (see FIG. 4) for securing the base support plate 12 to the back of cover casing 2. The base support plate 12 is used as a support to which the majority of the elements of the system are attached.

Figure 3:
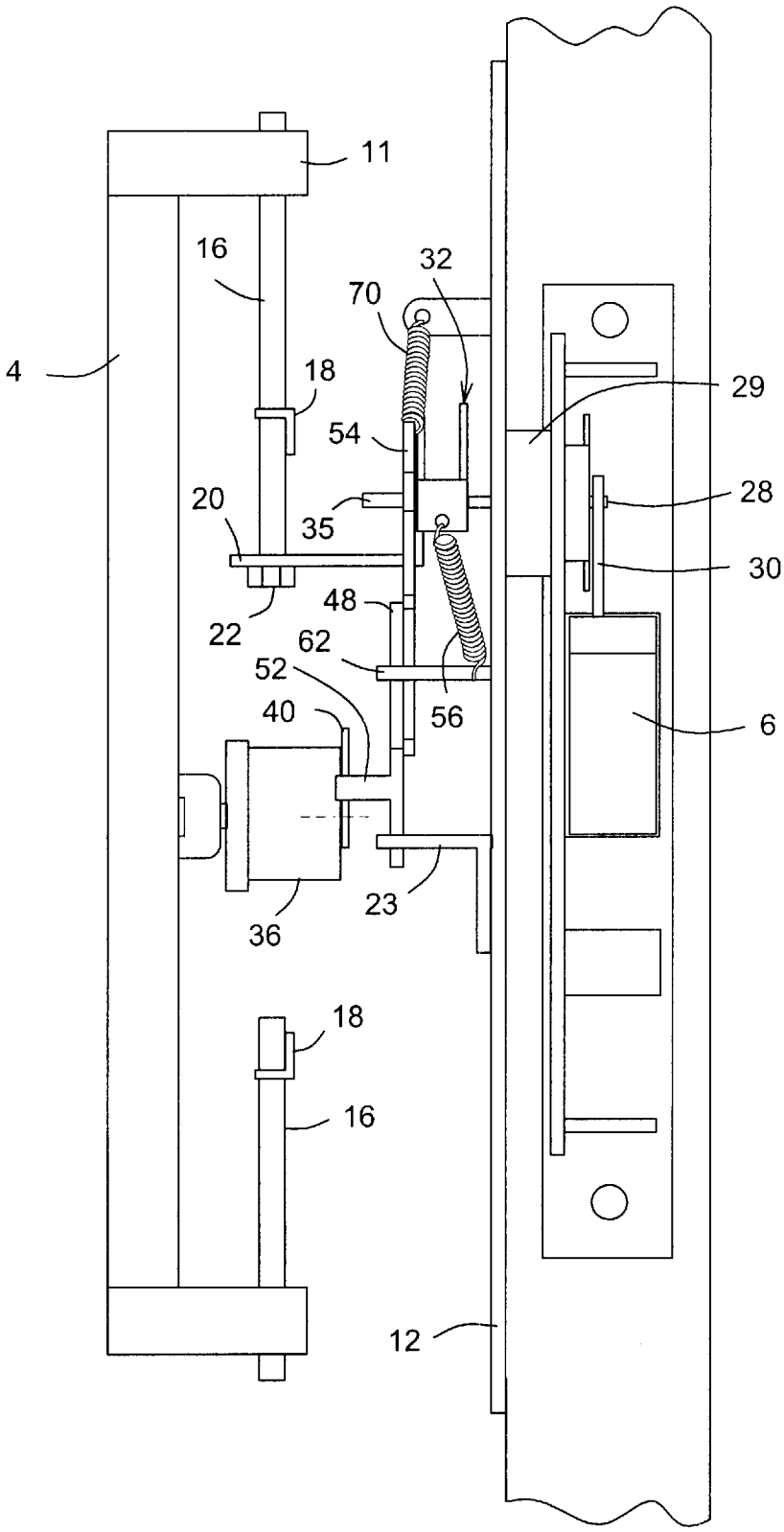
FIG. 3 is a schematic cross-sectional side view along 3—3 of the combination shown in FIG. 2 with the casing removed.

Now referring to FIGS. 2 and 3, a hidden extremity 11 of the door grasping means 4 is slightly chamfered to allow for its rotation about the axes of the pivot shafts 16. The two pivot shafts 16 are mounted in pin journals 18 of cover casing 2. A pusher means 20 is secured to the bottom part of the upper shaft 16. In this embodiment the pusher means is fixedly secured thereto by a nut 22, though other fastening means may also be used eg. welding or soldering. The pusher may also be formed integral with the shaft 16. In any event the pusher means 20 is terminated at the other end by an upward right angle pusher plate 24 (please refer for example to FIG. 4).

Figure 8:
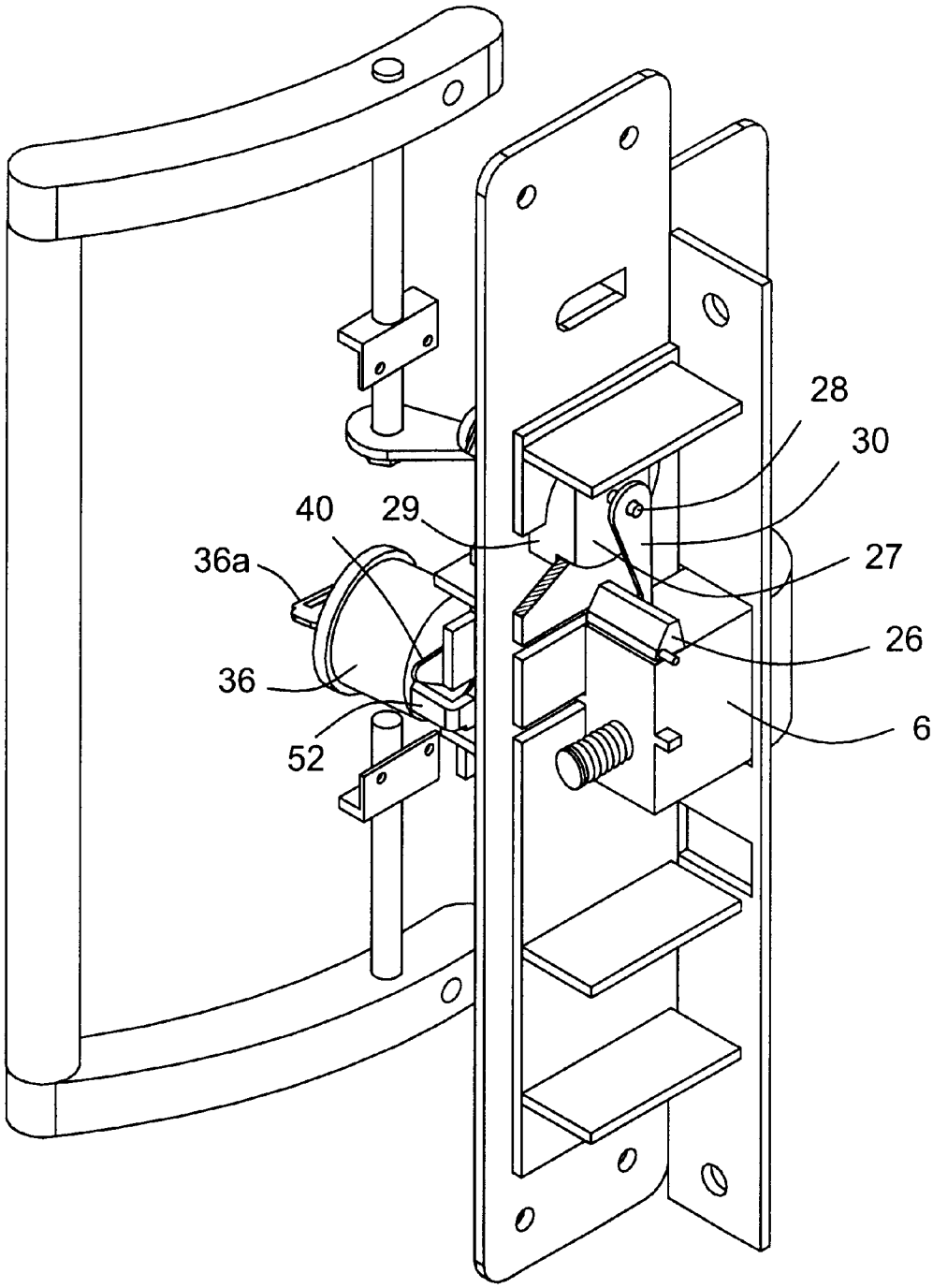
FIG. 8 shows the system as shown in FIG. 7 with door latching system added.
Figure 9:
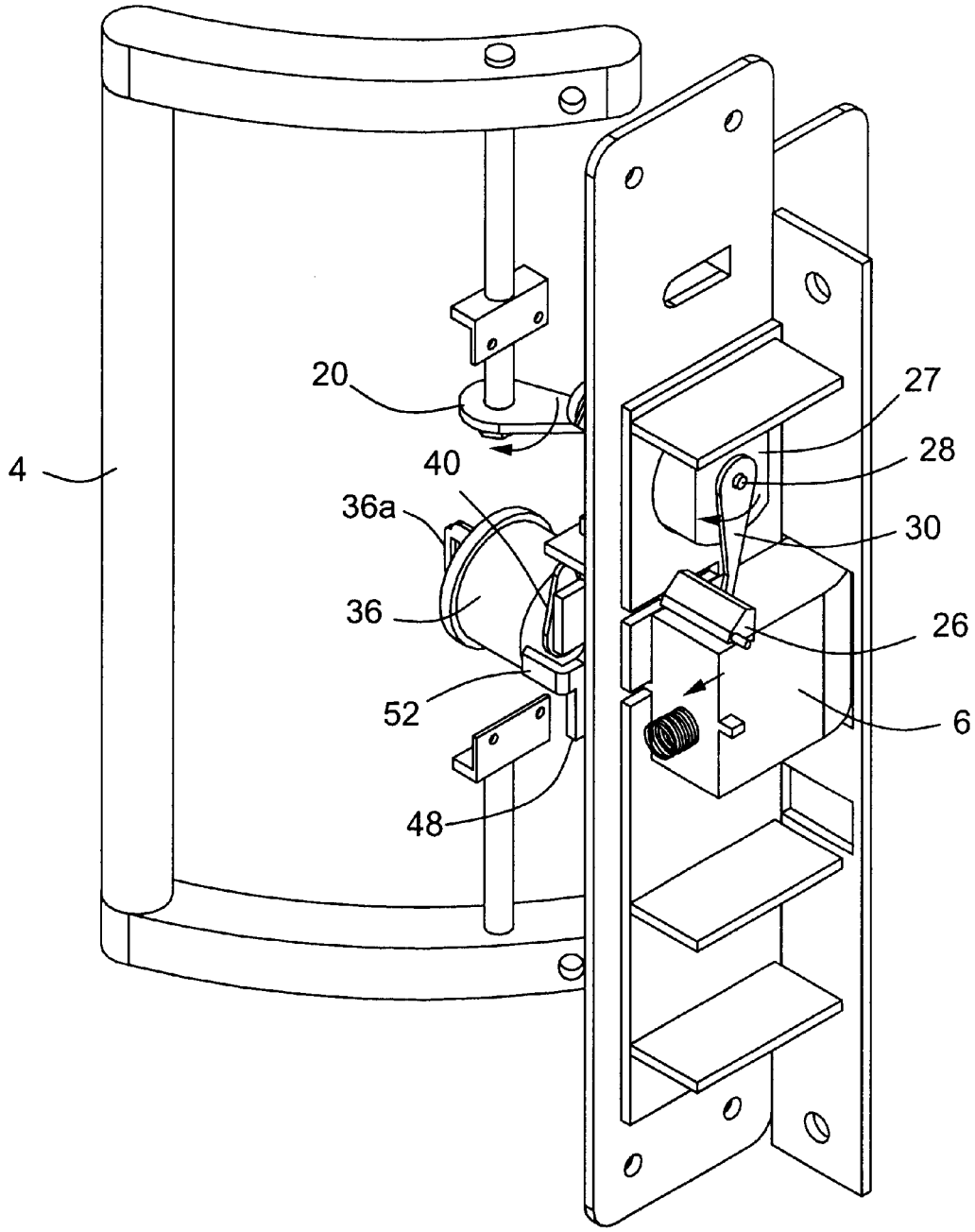
FIG. 9 is a schematic rear perspective view of the embodiment shown in FIG. 3, showing the handle in its second actuation position and the latching bolt being retracted.
Figure 10:
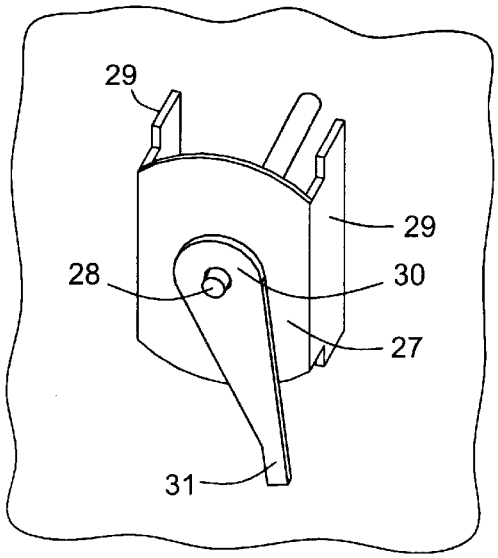
FIG. 10 is a schematic perspective view of an example retractor assembly attached to a section of a base plate.
Figure 11:
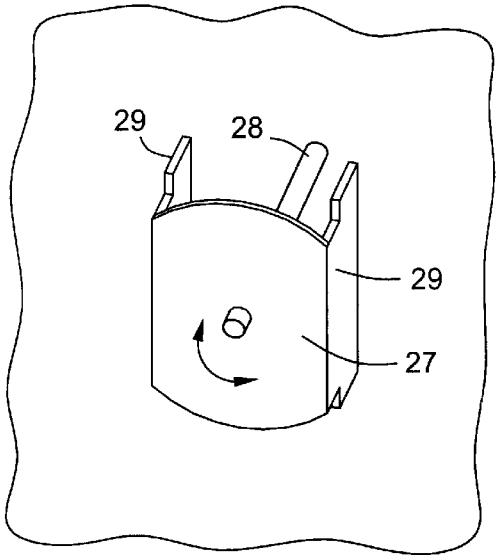
FIG. 11 is a schematic perspective view of the retractor assembly shown in FIG. 10 with the retractor removed.
Figure 12:
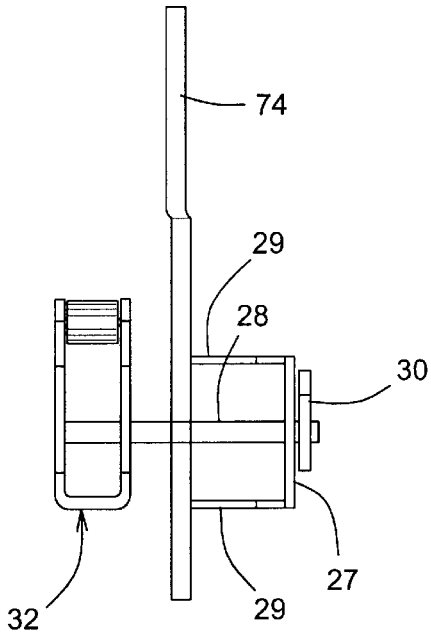
FIG. 12 shows the retractor assembly of FIG. 10 seen from above, with the retractor assembly on one side of the base plate and an intermediate engagement means on the other.
Figure 13:
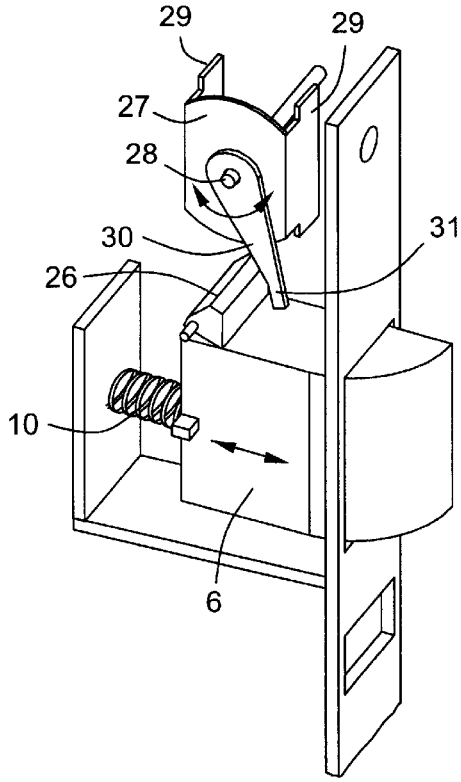
FIG. 13 is a schematic perspective view of the retractor assembly of FIG. 10 showing the retractor disengaged from the latch bolt means.
Figure 14:
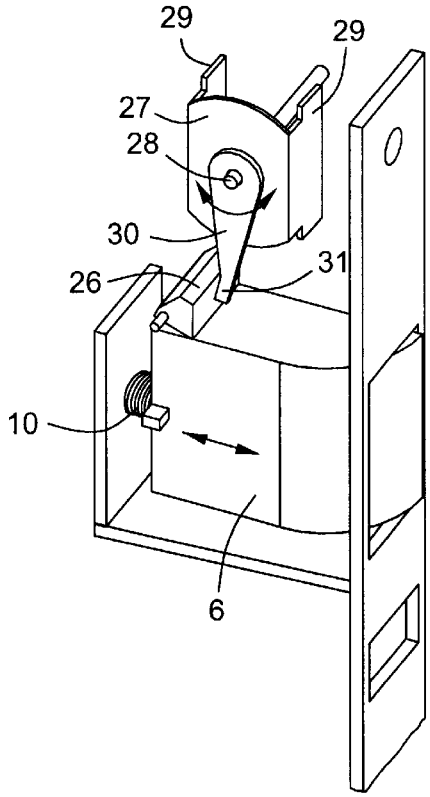
FIG. 14 is a schematic perspective view of the retractor assembly of FIG. 10 showing the retractor retracting an example latch bolt means.

FIGS. 8 and 9 show that the latch bolt means 6 in this embodiment has a top boss 26. FIGS. 10, 11, and 12 show a retractor assembly comprising a retractor means 30. The top boss 26 allows for a projection arm 31 of the retractor means 30 to engage the latch bolt means 6 and retract it (see FIGS. 13 and 14). The retractor assembly also comprising a pivot shaft 28 that extends through the base support plate 12, such that a first end of the pivot shaft 28 is on the first side of the base plate 12, and a second end of the pivot shaft 28 is on the second side of the base plate 12. Attached to second end of the pivot shaft 28 is the retractor means 30. On the first end is attached an intermediate engagement means 32 (see below). The intermediate engagement means 32 is attached to the pivot shaft 28, such that when the intermediate engagement member 32 is rotated the pivot shaft 28 is caused to rotate as well. This attachment may be accomplished in any suitable manner (eg. locking, soldering). Close to one end, the pivot shaft 28 is supported by a locator 27; the pivot shaft 28 is journalled to the locator 27 in any suitable manner. The locator 27 is fixed to the base support plate 12 via legs 29. The locator 27 and the legs 29 are configured so as to fit into a standard lock barrel hole. As seen in FIGS. 13 and 14, the retractor assembly is configured so that the projection arm 31 of the retractor means 30 can engage the top boss 26. Thus when the retractor means 30 moves from a first retractor position (see FIG. 13) to a second retractor position (see FIG. 14) the latch bolt means 6 is retracted. The movement of the retractor means 30 is accomplished by the rotation of pivot shaft 28.

Figure 15:
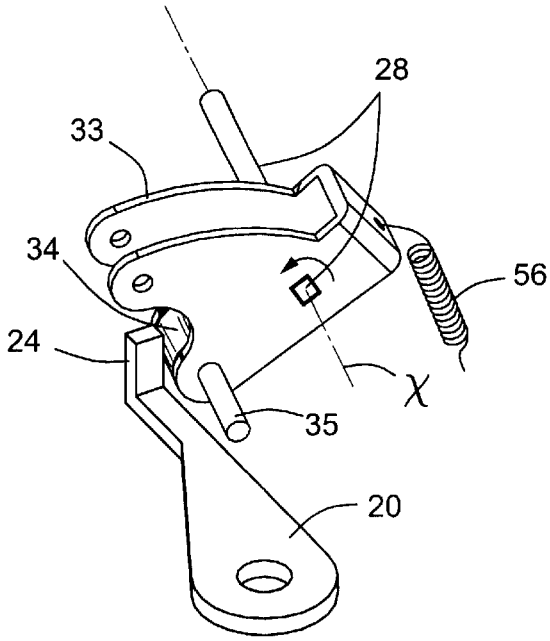
FIG. 15 shows a schematic perspective view of an intermediate engagement being engaged by a pusher means.
Figure 16:
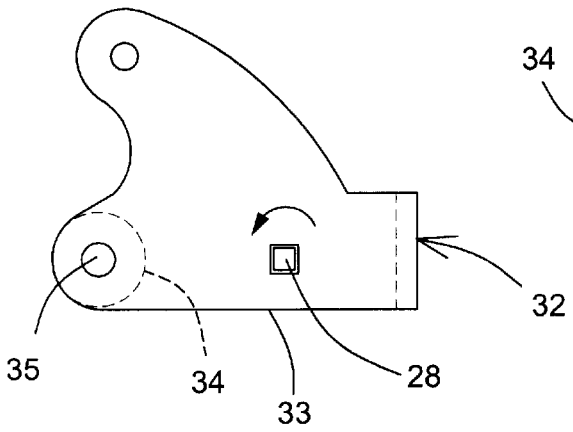
FIG. 16 is a schematic front view of the intermediate engagement means shown in FIG. 15.
Figure 17:
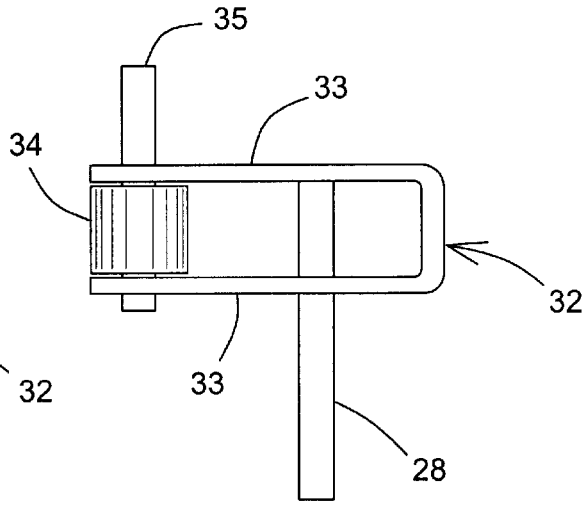
FIG. 17 is a schematic bottom view of the intermediate engagement means shown in FIG. 16 seen in the direction of the arrow in FIG. 16.

As shown in FIGS. 15, 16, and 17, the intermediate engagement means 32 is composed of two parallel arms 33, which are formed integral with each other and connected by a bridge member. Attached to the bridge member is a spring 56 (see below). Alternatively the two parallel arms 33 may be formed of separate pieces that are simply secured to each other through suitable means. The pivot shaft 28 is journaled through one arm and is fastened in the other, using conventional means. The intermediate engagement means 32 is provided with a roller 34 suitably mounted to the arms. The roller 34 provides a low resistance surface on the intermediate engagement means 32 where the pusher plate 24 may push so as to displace the intermediate engagement means 32. Rather than a roller, a (known) low friction (eg. arced) surface may be used (eg. a Teflon™ coated surface). Extending from one of the arms 33 of intermediate engagement means 32 is a pin projection 35.

Figure 18:
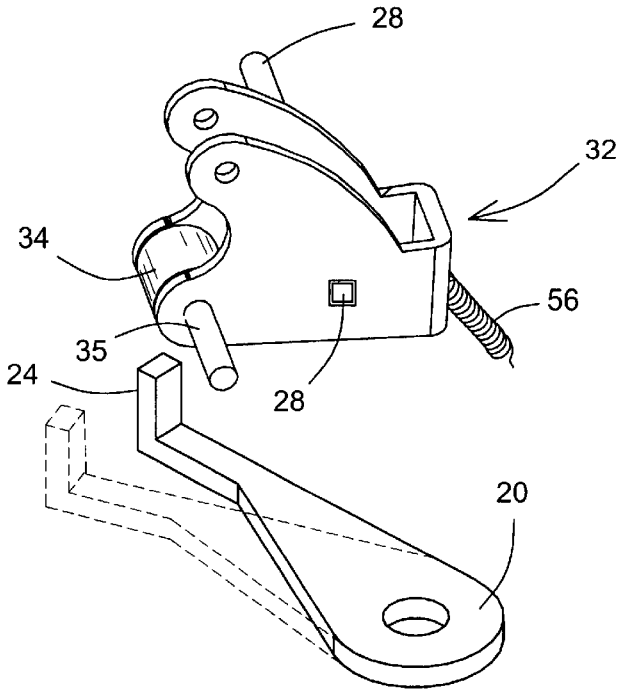
FIG. 18 show the intermediate engagement means of FIG. 15 in the second neutral position, wherein the pusher means is unable to engage the intermediate engagement means.
Figure 19:
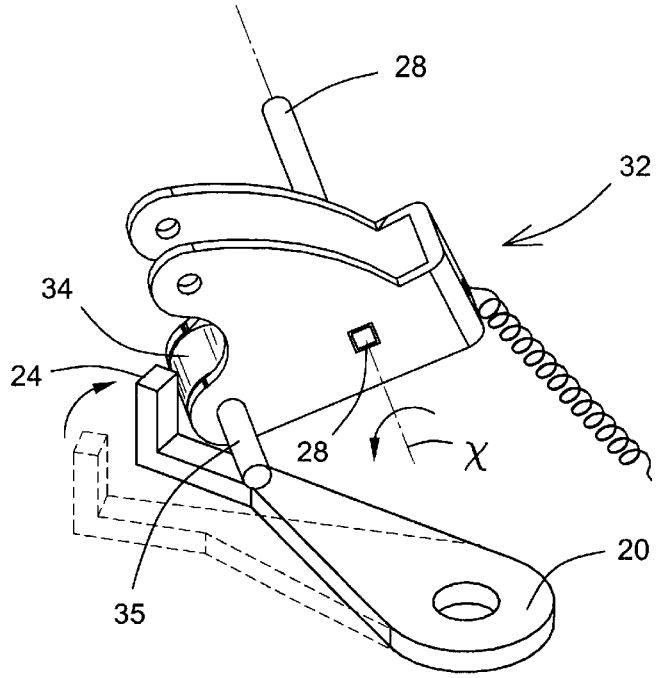
FIG. 19 shows the intermediate engagement means of FIG. 18 in the first engagement position being engaged by a pusher means.

Referring now to FIGS. 18 and 19, we see that the intermediate engagement means 32 is configured such that it can be rotated from a second neutral position to a first engagement position. As shown in FIG. 18, when the intermediate engagement means 32 is in said second neutral position the pusher means 20 is unable to engage the intermediate engagement means 32. As shown in FIG. 19, when the intermediate engagement means 32 is in said first engagement position the pusher means 20 may engage the intermediate engagement means 32. The intermediate engagement means 32 may thereby be caused to rotate about the axis x of pivot shaft 28.

The movement of the door grasping means 4 from the second non-working position to the first actuation position causes rotation of shafts 16. This in turn causes the rotation of pusher means 20. As seen in FIG. 19, the pusher plate 24 is then caused to move against roller 34, when it is properly positioned (see FIG. 18 for improper position). This in turn causes rotation around axis x of the intermediate engagement means and of the pivot shaft 28. As seen in FIGS. 13 and 14 the rotation of the pivot shaft causes the retractor means 30 to rotate and engage boss 26 of latch bolt means 6. As the retractor means 30 is rotated the latch bolt means 6 will be retracted, thus allowing the door to be opened.

As stated above the intermediate engagement 32 means needs to be properly positioned to allow the door to be opened. This means that the intermediate engagement means 32 must be moved from the position shown in FIG. 18 to the position shown in FIG. 19. This is in part accomplished by a conventional lock barrel means 36. Referring back to FIGS. 6 to 9, in the present case, unlocking of the door using the system is initiated using a conventional lock barrel 36 secured to the cover casing 2. The lock barrel has a key slot (not shown) into which a key 36*a* may be inserted. Attached to the lock barrel an unlocking cam 40 is secured to a rotatable cylinder of the lock barrel 36. The rotation of the key in the lab barrel 36 will cause the corresponding rotation of the unlocking cam 40.

Turning now to FIG. 20, this figure shows an example connector means 48*a* comprising a body member 48 which has laterally extending fingers 52. The extending fingers 52 are in the rotational path of an arm 40*a* of the unlocking cam 40 (see FIGS. 28 and 29). The upper part of body member 48 is disposed in guide slot 60 of a guide 62 (see FIG. 25). The guide 62 is secured to base support plate 12. The lower part of body member 48 is disposed in guide slot 21 of L plate 23. L plate 23 is also secured to base support plate 12.

The connector means 48*a* is also provided with a retainer member 54. The retainer member 54 is disposed in a guide slot 60 of guide 62. A connector pin 64 pivotally connects the lower end of the retainer member to the body member 48.

Figure 21:
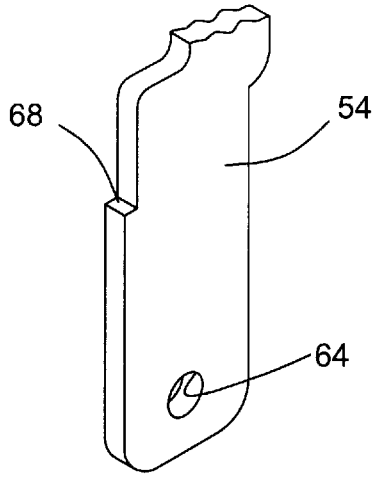
FIG. 21 is an enlarged partial schematic view of the retainer member shown in FIG. 20, with the hidden part exposed.

Retainer member 54 has a lateral extension 66 which overlies pin projection 35 (see for example FIG. 30). Retainer member 54 has also a connector retaining means which in this case is embodied as a step 68 adapted to underlie guide 62 at the end of slot 60 (see FIGS. 21 and 27). While the connector retaining means is embodied in this invention as a step underlying a guide any other suitable mechanism which accomplishes the same function may be used. For example an arm (not shown) which moves from a retracted to an extended position as the retainer member 54 is pulled down. The arm also being retracted as the intermediate engagement means 32 is rotated to retract the latch bolt 6.

As seen for example in FIG. 22, a helical spring 70 is attached at its upper end to a spring hook 58 and at its lower end to an ear 72. This ear 72 extended from the retainer member 54 as shown in FIG. 22. The helical spring 70 is an example embodiment of a connector biassing means.

Referring to FIGS. 30 to 32, the spring 56, which in this case is a helical spring, is attached to the inner end of intermediate engagement means 32 and to guide 62. The spring 56 is one example embodiment of a reset biassing means. The spring 56 biases the intermediate engagement means 32 into the second neutral position as shown in FIG. 30. In this position the roller 34 is lying above the pusher plate 24. In this position (as shown in FIG. 30) the pin projection 35 also lies just underneath the lateral extension 66 of retainer member 54. Since the intermediate engagement means 32 is connected to the retractor means 30 through pivot shaft 28, the spring 56 also ensures that the retractor means 30 is biassed in said first retractor position. While in this embodiment the spring 56 is directly attached to the intermediate engagement means 32, the spring 56 may alternatively be directly attached to the retractor 30 an still perform the same function(s). Alternatively the intermediate engagement means 32 and the retractor means 30 may be provided with separate biassing means.

Stated otherwise the helical spring 70 and the spring 56 means may form part of system biassing means comprising three biassing components. In this case the spring 56 would make up a first biassing component, while the spring 70 would make up a second and a third biassing component. The spring 70 would make up two components since it gives the retainer member 54 a bias in two directions ie. in an x and a y direction. The system may also function with a structure in which the spring 70 is disposed so as to only provides a bias in the horizontal x-direction. In this case the spring 56, may be configured so as to provide sufficient biassing force through pin projection 35 so as to provide the vertical y-direction bias for the retainer member 54. Alternatively separate springs could be provides to provide the connector means 48*a* with the necessary bias in the x-direction, and in the y-direction.

Referring now to FIGS. 30, 31, and 32, we see a progression of the system as the system is being activated. The system starts out in an inactive states as shown in FIG. 30.

In this state the intermediate engagement means 32 is in its second neutral state wherein the intermediate engagement means 32 cannot be engaged by the pusher plate 24 of the pusher means 20. The retainer member 54 of the connector means 48a is then pulled down as described above, to the position shown in FIG. 31. In this position the step 68 lies under the guide 62, the retainer member 54 will therefore not return to the position of FIG. 30. In the position of FIG. 31, the intermediate engagement means 32 has been brought down by the lateral extension 66 of the retainer 54, such that the intermediate engagement means 32 is now in the path of the pusher plate 24 of the pusher means 20. As the pusher means 20 is displaced the pusher plate 24 with push against the intermediate engagement means 32 and cause it to displace. As the intermediate engagement means 32 is displaced the pin projection 35 will push against the retainer member 54 and push the step 68 out from under the guide 62 (see FIG. 32). The retainer member 54 is now free to return to the position of FIG. 30. As the pusher means 20 is moved back to its original position the intermediate engagement means 32 returns to the second neutral position as shown in FIG. 30.

Figure 4:
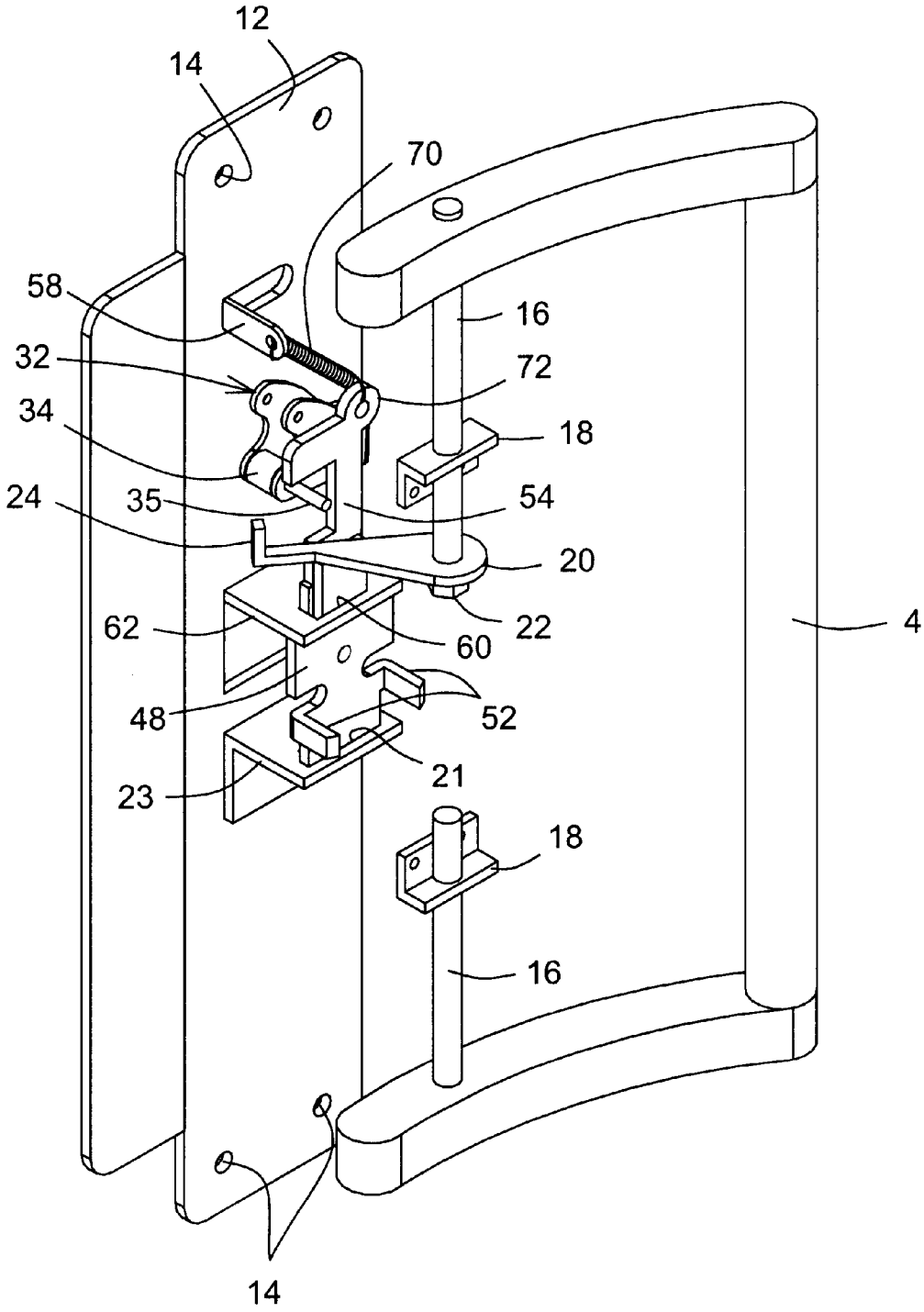
FIGS. 4 and 5 are each schematic perspective views of the embodiment shown in FIG. 3 with the lock barrel means removed; showing the stages that the system goes through when used.
Figure 5:
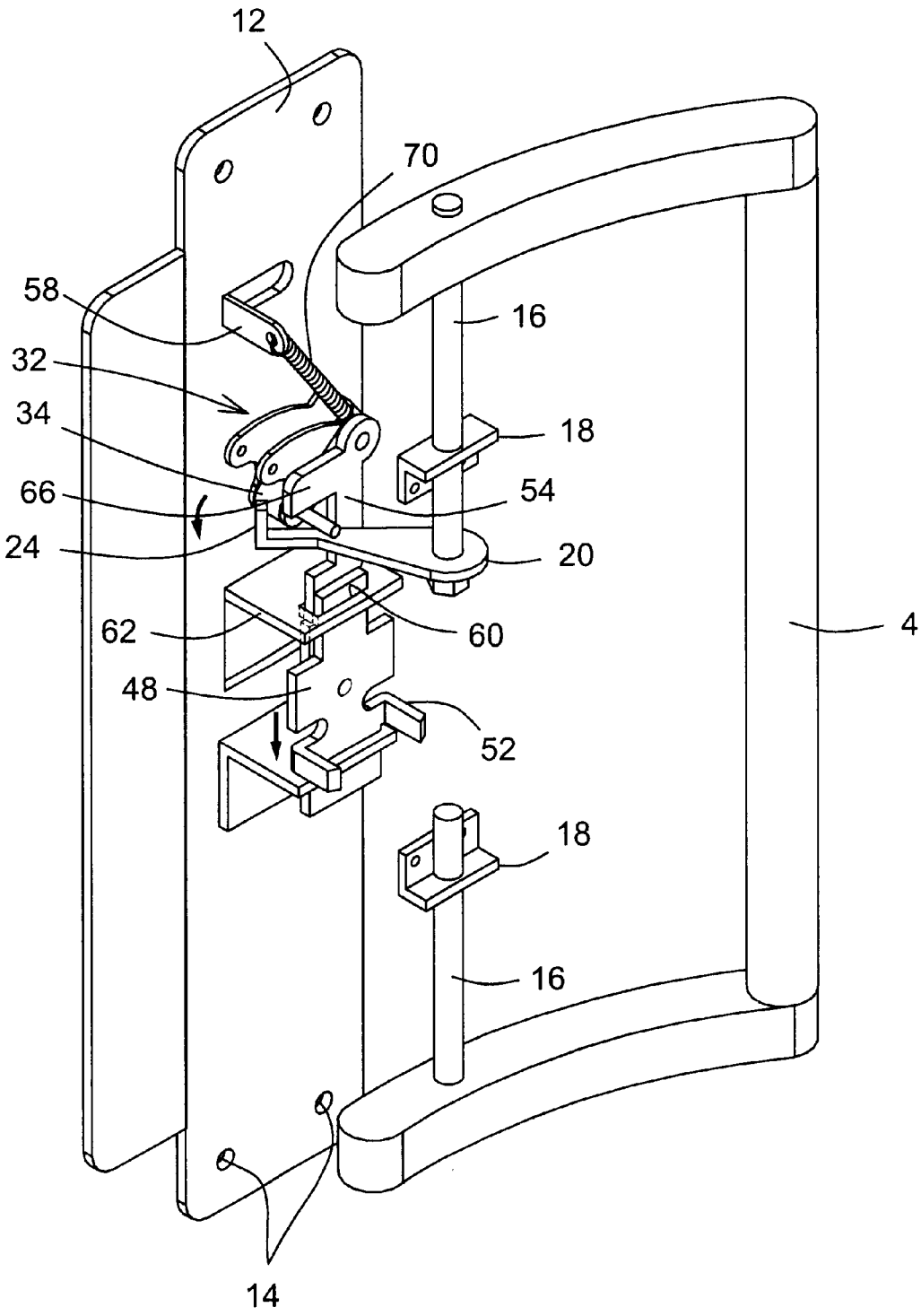
Figure 6:
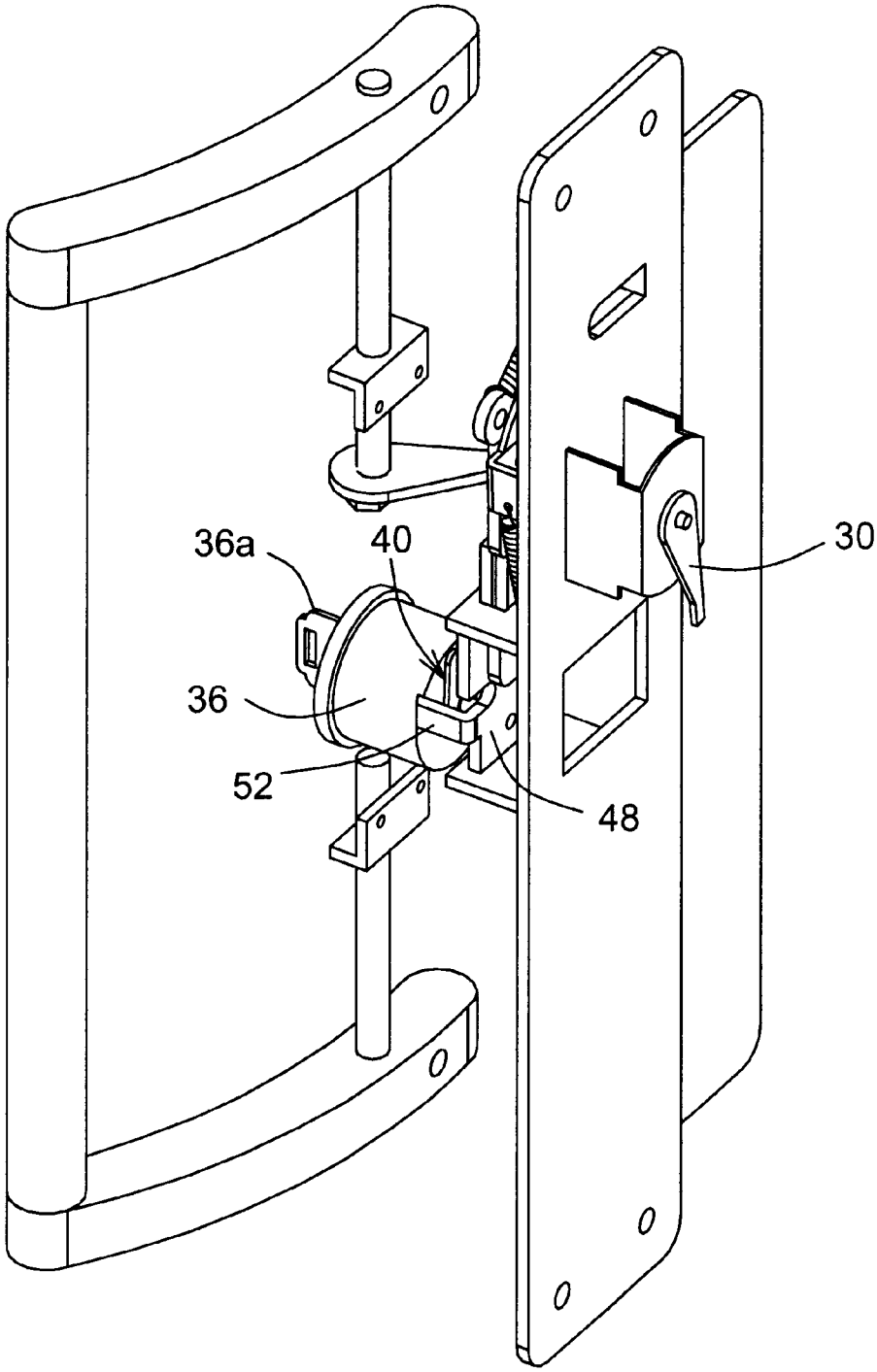
FIG. 6 is a schematic rear perspective view of the embodiment shown in FIG. 3, showing the system in a non-working position.
Figure 7:
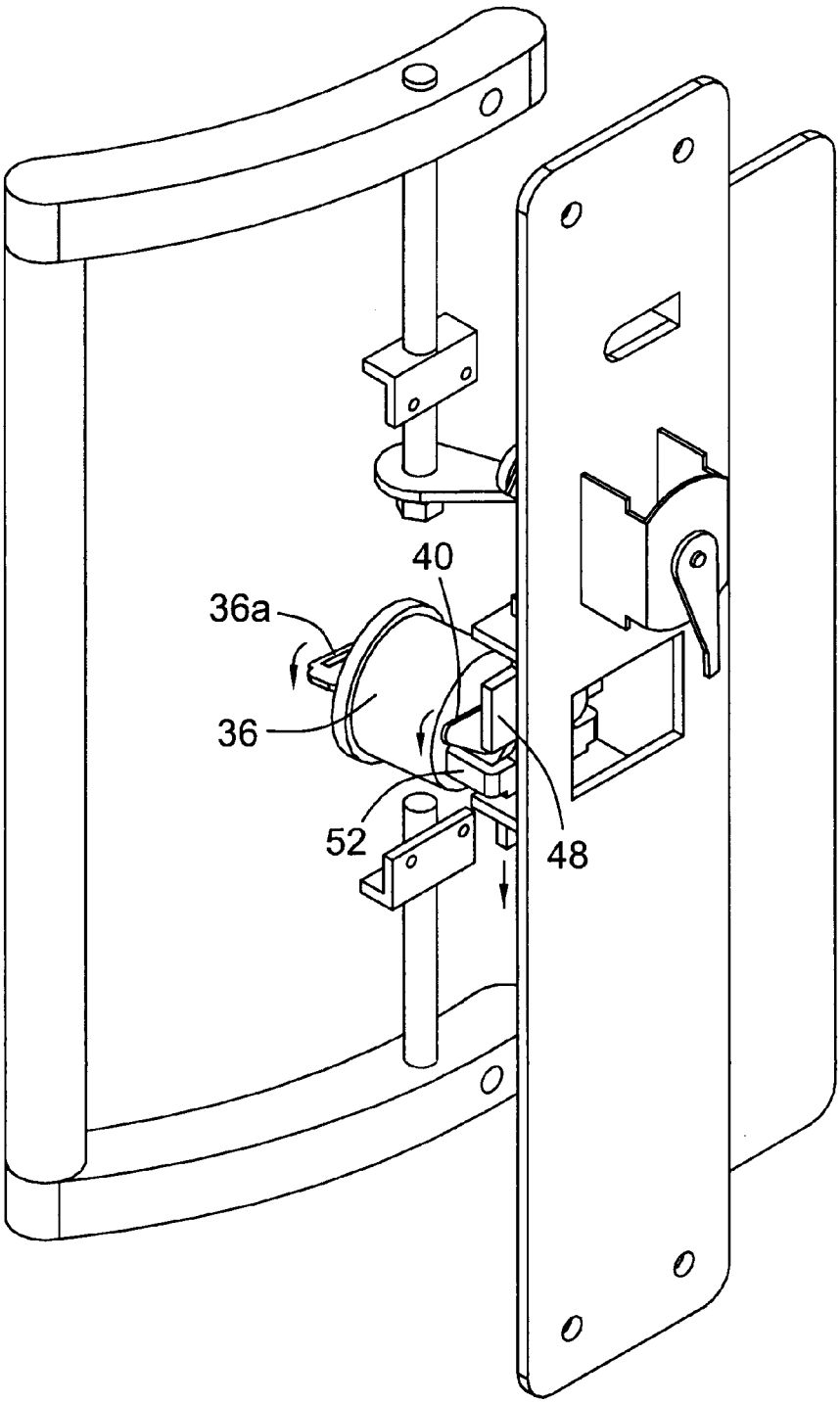
FIG. 7 is a schematic rear perspective view of the embodiment shown in FIG. 3, of the unlocking system showing the system being activated by a key.

In the embodiment described above the system operates as follows: referring to FIGS. 4 and 6 the door is in locked condition and the intermediate engagement means 32 is in a second neutral position (see in more detail FIG. 18). In this position the body member 48 in upmost position together with the retainer member 54. The retainer member 54 is given a leftward bias by a helical spring 70, but is prevented from moving by being fitted in guide slot 60. Pin projection 35 lies just under the lateral extension 66 of retainer member 54 (see FIG. 30) and the retractor means 30 in disengaged from top boss 26 (see FIG. 13). The latch bolt means 6 is therefore in its extended position due to coil spring 10. The door is thus locked. When it is decided to unlock the door, lock barrel means 36 is used by means of a key. The key is inserted in the key slot and is then rotated. This causes the unlocking cam 40 to rotate to the left or to the right. FIGS. 28 and 29 show the unlocking cam 40 being moved to the right. This will cause the unlocking cam 40 to engage one or the other of the two lateral fingers 52 of body member 48.

The retainer member 54 is thus caused to move down and its lateral extension 66 is caused to engage pin projection 35. This in turn causes rotation of the intermediate engagement means 32 downwardly. After the intermediate engagement means 32 has been rotated the roller 34 is on may be engaged by as pusher plate 24 as shown in FIG. 31.

As the retainer member 54 moves down the spring 70 will cause it to be pulled left so that a step 68 will underlie and engage the lower guide 62. The key can now be removed since the retainer member 54 will be kept in its lowered position. The retainer member 54 in turn keeps the intermediate engagement means 32 in a lowered position. The movement of the retainer member 54 and the body member 48 is shown in FIGS. 22, 23, and 24, and in more detail in FIGS. 25, 26, and 27. As can be seen the retainer member 54 and the body member 48 are initially lying along the same axis, but as the connector means 48*a* moves down the retainer member 54 is pulled left so that the axis of the retainer member 54 and the axis of the body member 48 are at an angle alpha to each other. The angle alpha can be any suitable size (keeping in mind the purpose of the step 68 of the retainer member 54) and may for example be about 5 degrees.

The door unlocking system remains in the configuration of FIG. 24 until a user pulls on door grasping means 4 to open the door 1. The door grasping means 4 is rotated in direction of arrow 5 causing pusher plate 24 to move to the right and engage roller 34 (see FIG. 32). This then causes the counterclockwise movement of the intermediate engagement means 32. Consequently the retractor means 30 is rotated and retracts the latch bolt means 6. The opening of the door is thus enabled as the door grasping means 4 is being pulled.

As the rotation of the intermediate engagement means 32 causes the latch bolt means 6 to be retracted, the pin projection 35 pushes the retainer member 54. The retainer member 54 is pushed towards the right. As the angle alpha becomes smaller the axis of the retainer member 54 and the axis of the body member 48 slowly become aligned. When the axis are aligned the step 68 is pushed out from under guide 62 and the connector retaining means is caused to disengage.

When the door grasping means 4 is released it returns to its original position due to the door grasp biassing means. As the pusher plate 24 disengages the roller 34, the intermediate engagement means returns to the initial position as shown in FIG. 30 under the action of the spring 56. As the intermediate engagement means returns to its second neutral position the retractor means 30 completely releases the latch bolt means 6. The latch bolt means is then pushed out of the door under the power of spring 10. The door is then relocked as the latch bolt means enters the door frame 3. With intermediate engagement means 32 in its second neutral position, the door is locked since pusher plate 24 will freely move below roller 34 without activating the retraction of the latching bolt 6.

Alternatively a system may be fitted with a second example connector means comprising a modified version of retainer member 54 which allows for additional functionality. FIGS. 33 to 36 show the system with the alternate retainer member 54*a*. In this alternate version the retainer member 54*a* is disposed in the guide slot of a retainer guide 55. The retainer member 54*a* has a lateral extension 66 which overlies pin projection 35. As seen in FIGS. 37 and 38, retainer member 54*a* has also a modified connector retaining means which in this case comprises of top step 51 and retainer guide 55. The modified connector retaining means is adapted to allow the retainer member 54*a* to retain the intermediate engagement 32 means in the first engagement position. The retainer member 54*a* also has releasable locking means which comprises of a retainer hook 57. The retainer hook 57 comprises a projection 57*a*, and the groove 57*b*. The retainer hook 57 is configured to engage a finger 55*a* of the retainer guide 55.

A helical spring 59 (see for example FIG. 39) is attached to the retainer guide 55 at its upper end and to an ear 72 at its lower end. This ear 72 extends from the retainer member 54*a* as clearly shown in FIG. 37. The spring 59 functions similarly to spring 70, and is another example of a connector biassing means. Alternatively the spring 59 and the spring 56 can make up three biassing components of a biassing means, in the same way as spring 70 and the spring 56.

Referring now to FIGS. 44 to 47, these figures show the interaction of the intermediate engagement means 32 with the retainer member 54*a*, and the pusher means 20. FIG. 44 shows the system in an active state wherein the intermediate engagement means 32 is in the second neutral position. As can be seen the pusher means 20 is below the intermediate engagement means 32 and cannot engage the intermediate engagement means 32.

As the retainer member 54*a* is brought down the intermediate engagement means 32 will also be brought down. This configuration can be seen in FIG. 45. As the retainer member 54*a* clears the guide slot of the guide 55, the retainer member 54*a* will be pulled left by the spring 59. This will in turn cause the retainer member 54*a* to move to the position of FIG. 46, wherein the retainer member 54*a* is being retained under the retainer guide 55. In this position the intermediate engagement means 32 is in the path of the pusher plate 24 of the pusher means 20. As the pusher means 20 moves the pusher plate 24 will engage the intermediate engagement means 32. This will in turn cause the projection pin 35 to push against the retainer member 54*a* such that the retainer member 54*a* is pushed out from under retainer guide 55. The retainer member 54*a* is now free to move up under the power of spring 59. This configuration can be seen in FIG. 47. As the pusher is moved to the left the intermediate engagement means 32 will return to the position of FIG. 44 under the power of spring 56.

Alternatively the retainer member 54*a* allows for a different configuration. In this configuration the system moves from the position of FIG. 44 to the position of FIG. 45. While in the position of FIG. 45 the pusher may be caused to move against the intermediate engagement means 32. This in turn caused the projection pin 35 to push against the retainer member 54*a,* and moving the retainer member 54*a* to the position of FIG. 48. As the retainer member 54*a* is allowed to move up the retainer hook 57 will catch on finger 55*a* of the retainer guide 55, as shown in FIG. 49. The retainer member 54*a* will now remain in this position until the retainer member 54 is again pulled down thus freeing the retainer hook 57 and allowing the retainer member 54*a* to return to the position of FIG. 44. While the retainer member 54*a* is in the position of FIG. 49, the intermediate engagement means 32 will be kept in the path of the pusher plate 24 of the pusher means 20. This will allow the door to be opened repeatedly.

If a system is fitted with the second example retainer member 54*a* (see FIGS. 33 to 36) then the system functions as follows. Normal operation is analogous to that of the first example retainer member the only difference being that step 51 underlies retainer guide 55, rather than step 68 underlying guide 60. This operation can be gleaned from FIGS. 44 to 47.

The second example retainer member does provide an added functionality which can be seen in FIGS. 39, 40, 42 and 43. The added functionality functions as follow: by turning the key left or right the unlocking cam 40 with push down the left or right finger 58 of the body member 48 thereby bringing it down. Attached to the body member 48 is the retainer member 54*a*. Therefore as the body member 48 is brought down the retainer member 54*a* is brought down as well. When the retainer member 54*a* is brought down it will go under the retainer guide 55 (see FIG. 40). As the retainer member 54*a* moves down the retainer member 54*a* causes the intermediate engagement means 32 to move by hitting the pin projection 35. The effect of this move is that the intermediate engagement means 32 is moved into the path of the pusher means 20 (see FIG. 45). While turning the key the door grasping means 4 is pulled, thus causing the pusher means 20 to push on the intermediate engagement means 32. This will cause the pusher means 20 to rotate the intermediate engagement means 32. As the intermediate engagement means 32 rotates the pin projection 35 pushes the retainer member 54*a* to the right (see FIGS. 42 and 48). This will in turn cause the top right portion of the retainer member 54*a* to go under the right part of the retainer guide 55. The key may now be released which will cause retainer member 54*a* to move up and cause retainer hook 57 to be caught under retainer guide 55 as seen in FIGS. 43 and 49. In this configuration the intermediate engagement means 32 will be retained in the path of the pusher means 20. The system will then remain in this position until the key is again turned. When the key is turned again the retainer member 54*a* will be pulled down thus freeing the retainer hook 57. The retainer member 54*a* will now return to the position of FIG. 47 under the power of spring 59.

In accordance with a further embodiments of the system, the door may be unlocked by a remote source. In this case the unlocking of the door may be initiated independently using a solenoid 44. The solenoid is secured to the inside of the base support plate 12, by solenoid bracket 43. The solenoid 44 comprising a plunger 46 and is connected to a remote energy source (not shown). The remote energy source comprises activation means which control whether or not to energize the solenoid 44.

The solenoid 44 may be provided in two different ways. In a first way as shown in FIGS. 50 to 54*a,* the plunger 46 is pivotally secured to the lower part of an extension arm 47 by pin 45. The upper end of extension arm 47 is pivotally secured to the intermediate engagement means 32 by pin 49. The plunger 46 and the solenoid 44 is disposed such that when the solenoid is not operating, the plunger 46 is kept extended due to its connection to the intermediate engagement means 32. This is of course only for convenience and the solenoid 44 may be provided with its own solenoid biassing means for keeping the plunger 46 extended. FIG. 53 shows the solenoid and the system using with the first example retainer member, and FIG. 54 show the solenoid and the system using the second example retainer member.

In the second way as shown in FIGS. 55–57, the plunger 46 is secured to the body member 48 by pin 50. When the solenoid 44 is not operating the plunger 46 is kept extended by its connection to the body member. This is of course only for convenience and the solenoid 44 may be provided with its own solenoid biassing means for keeping the plunger 46 extended.

The system may be activated by the solenoid 44. Depending on the placement of the solenoid 44 in the system energising system will have a different effect. This effect is independent of the retainer member and as such can be used with any retainer member. If the solenoid is placed in the first position (see FIGS. 50–54) then the solenoid 44 will pull plunger 46 downwardly. This causes the extension arm 47 to rotate the intermediate engagement means 32. Consequently the pivot shaft 28 rotates the retractor means 30 so that the latch bolt means 6 is retracted. The door can now be opened. When the solenoid 44 is de-energised it will release plunger 46. Plunger 46 will return to the initial position as shown in FIG. 50 under the action of spring 56. This allows the intermediate engagement 32 means to return to its second neutral position. This will in turn cause the retractor means 30 to release the latch bolt means 6. The latch bolt means 6 is then pushed outwardly of the door by spring 10 thus allowing the door to be locked. With intermediate engagement means 32 in its second neutral position, the door is locked since pusher plate 24 will freely move below roller 34 without activating the retraction of the latching bolt 6.

If the solenoid 44 is placed in its second position as shown in FIGS. 55–57, then the energizing of the system will cause the solenoid 44 to retract the plunger 46. The plunger 46 is attached to body member 48 which will in turn be pulled down. The system therefore works the same way as it would had it been activated using the lock barrel 36.

In this embodiment the invention may also be provided with means to prevent unauthorized entry. As seen in FIG. 2 and also in FIG. 4, the base support plate 12 has an inwardly offset shield flange 74 which covers the lip 76 of cover casing 2 (see FIG. 2), this lip and shield flange spacedly overlying the edge of the door frame 1*a* when the door is in closed position. The shield flange 74 and the lip 76 therefore clears the door frame 1*a* while it prevents access to the latch bolt means 6 by unauthorized persons trying to gain access to said latch bolt means 6 by insertion of a plastic card of the like between the door 1 and the door frame 3.

SYSTEM PARTS IN FIG. 1–24

| | |
|---|---|
| 2 | Casing |
| 4 | Handle |
| 6 | Latch bolt means |
| 8 | Bevelled Face of 6 |
| 10 | Spring of 6 |
| 11 | Hidden Extremity of 4 |
| 12 | Base Plate |
| 14 | Screw Holes |
| 16 | Handle Shafts |
| 18 | Pin ournals for 16 |
| 20 | Pusher |
| 21 | Guide Slot of 23 |
| 22 | Nut for 20 |
| 23 | L plate |
| 24 | Pusher Plate of 20 |
| 26 | Top Boss of 6 |
| 27 | Locator |
| 28 | Pivot shaft |
| 29 | Legs of 27 |
| 30 | Retractor means |
| 32 | Intermediate engagement means |
| 33 | Parallel Arms of 32 |
| 35 | Manuel Unlocking And Reset Shaft |
| 36 | Lock Barrel |
| 38 | Key Slot |
| 40 | Unlocking Cam |
| 42 | Rotation Axis of 40 |
| 43 | Solenoid Bracket |
| 44 | Solenoid |
| 45 | Pin |
| 46 | Plunger of 44 |
| 47 | Extension Arm |
| 48 | Body member |
| 49 | Pin |
| 50 | Pin |
| 51 | Top step |
| 52 | Finger of 48 |
| 53 | Guide slot of 55 |
| 54 | Retainer member |
| 55 | Retainer Guide |
| 56 | Spring of 32 |
| 57 | Hook of 54 |
| 58 | Spring hook of 70 |
| 59 | Extension spring |
| 60 | Guide Slot of 62 |
| 62 | Guide |
| 64 | Connector Pin of 48 and 54 |
| 66 | Lateral Extension of 54 |
| 68 | Step in 54 |
| 70 | Spring of 54 |
| 72 | Ear of 54 |
| 74 | Inwardly Offset Shield Flange of 12 |
| 76 | Lip of 2 |
| 78 | Spring of 4 (and 11) |
| 79 | Holding Screw for 2 |
| 80 | Hole Channel for Retaining Screw of 16 |
| 81 | Retaining Screw of 16 |

I claim:

1. A door unlocking system for use with a door combination comprising a door, a door enclosure border, and a door locking means, said door being displaceable between an open and a closed position, said door locking means comprising a lock barrel means, a female element and a latch bolt means comprising a male member, said lock barrel means being displaceable between an inactive configuration and an active configuration, said door comprising said latch bolt means, said door enclosure border comprising said female element, said male member and said female element being disposed and configured such that said male member is displaceable between an extended position wherein said female element is able to receive the male member for locking said door in said closed position and a retracted position wherein said male member is retracted from said female element so that said door is displaceable from said closed position to said open position, said latch bolt means comprising bolt biassing means for biassing the male member in said extended position, the door unlocking system comprising:

a door grasping means displaceable between a first non-working position and a second actuation position, door grasp biassing means biassing the door grasping means in said first non-working position, pusher means operatively connected to said door grasping means;

an intermediate engagement means;

system biassing means comprising a first biassing component, a second biassing component, and a third biassing component;

a retractor means operatively connected to the intermediate engagement means;

connector means operatively connected to said lock barrel means; and connector retaining means displaceable between a retaining position and a non-retaining position;

said retractor means being displaceable between a first retractor position and a second retractor position such that when the retractor means is displaced from said first retractor position to said second retractor position the retractor means engages the latch bolt means and urges the displacement of the male member from said extended position to said retracted position, and when the retractor means is displaced from said second retractor position to said first retractor position the retractor means disengages the male member such that the bolt biassing means displaces the male member to said extended position;

said intermediate engagement means being displaceable between a first engagement position, wherein the pusher means is able to engage the intermediate engagement means such that said intermediate engagement means may be urged thereby to induce the retractor means to be displaced from said first retractor position to said second retractor position, and a second neutral position wherein the pusher means is unable to engage the intermediate engagement means;

said first biassing component biassing the intermediate engagement means in the second neutral position;

said retractor means and said intermediate engagement means being disposed and configured such that when the intermediate engagement means is in said second neutral position the retractor means is in said first retractor position, and such that when the intermediate engagement means is in said first engagement position the retractor means is in said second retractor position;

said connector means being displaceable between an engagement configuration wherein the connector means engages and retains the intermediate engagement means in said first engagement position, and a disengagement configuration wherein the intermediate engagement means is in said second neutral position, said connector means being configured, such that when said lock barrel means is displaced from the inactive configuration to the active configuration, the lock barrel means displaces the connector means from said disengagement configuration to said engagement configuration, such that the intermediate engagement means induced to be displaced from said second neutral position to said first engagement position, and said connector retaining means is induced to displace from said non-retaining position to said retaining position by said second biassing component;

said third biassing component biassing said connector means in said disengagement position;

said connector retaining means being disposed such that when the connector retaining means is in said retaining position the connector retaining means retains the connector means in said engagement configuration, and such that when the connector retaining means is in said non-retaining position the connector means is caused to return to said disengagement configuration by said third biassing component;

said connector means, said door grasping means, said pusher means, and said retractor means being disposed and configured such that:

(A) when said connector means is in said engagement configuration and said door grasp means passes from said first non-working position to said second actuation position the pusher means engages said intermediate engagement means in said first engagement position so as to induce the connector retaining means to be displaced from said retaining position to said non-retaining and so as to induce the intermediate engagement means to displace the retractor means from said first retractor position to said second retractor position, and (B) when said door grasp means passes from said second actuation position to said first non-working position, the pusher means disengages the intermediate engagement means such that said first biassing component urges said intermediate engagement means to reset to said second neutral position, and said retractor means to reset to said first retractor position.

2. A door unlocking system as described in claim 1, wherein said door grasping means is a handle means.

3. The door unlocking system as described in claim 1, wherein the system further comprises:

a releaseable locking means; said releasable locking means comprising a locked configuration in which said releaseable locking means releasably locks connector means in said engagement configuration and an unlocked configuration in which the connector means is free to return to the disengagement configuration;

said releaseable locking means, said door grasping means, said connector means, and said pusher means being disposed and configured such that (A) when said lock barrel means is in said active configuration and the connector means is inducing displacement of said intermediate engagement means from said second neutral position to said first engagement position, the door grasping means can pass from said first non-working position to said second actuation position such that the pusher means engages said intermediate engagement means and induces said releaseable locking means to be displaced from said unlocked configuration to said locked configuration; and (B) when said intermediate engagement means is releaseably locked in said first engagement position by said releaseable locking means and said lock barrel means changes from said inactive configuration to said active configuration, said connector means is displaced such that said releaseable locking means is induced to be displaced from said locked position to said unlocked position such that said first biassing component urges said intermediate engagement means to pass to said second neutral position.

4. A door unlocking system for use with a door combination comprising a door, a door enclosure border, and a door locking means, said door being displaceable between an open and a closed position, said door locking means comprising a lock barrel means, a female element and a latch bolt means comprising a male member, said lock barrel means being displaceable between an inactive configuration and an active configuration, said door comprising said latch bolt means, said door enclosure border comprising said female element, said male member and said female element being disposed and configured such that said male member is displaceable between an extended position wherein said female element is able to receive the male member for locking said door in said closed position and a retracted position wherein said male member is retracted from said female element so that said door is displaceable from said closed position to said open position, said latch bolt means comprising bolt biassing means for biassing the male member in said extended position, the door unlocking system comprising:

a door grasping means displaceable between a first non-working position and a second actuation position, door grasp biassing means biassing the door grasping means in said first non-working position, pusher means operatively connected to said door grasping means;

an intermediate engagement means;

a reset biassing means;

a retractor means operatively connected to the intermediate engagement means;

retractor biassing means;

connector means for operatively connecting said lock barrel means to said intermediate engagement means; and connector biassing means; and connector retaining means;

said retractor means being displaceable between a first retractor position and a second retractor position such that when the retractor means is displaced from said first retractor position to said second retractor position the retractor means engages the latch bolt means and urges the displacement of the male member from said extended position to said retracted position, and when the retractor means is displaced from said second retractor position to said first retractor position the retractor means disengages the male member such that the bolt biassing means displaces the male member to said extended position;

said retractor biassing means biassing the retractor means in said first retractor position;

said intermediate engagement means being displaceable between a first engagement position, wherein the pusher means is able to engage the intermediate engagement means such that said intermediate engagement means may be urged thereby to induce the retractor means to be displaced from said first retractor position to said second retractor position, and a second neutral position wherein the pusher means is unable to engage the intermediate engagement means;

said reset biassing means biassing the intermediate engagement means in the second neutral position;

said connector retaining means being displaceable between a retaining position and a non-retaining position;

said connector means being displaceable between an engagement configuration in which the connector means engages and retains the intermediate engagement means in said first engagement position, and a disengagement configuration wherein the intermediate engagement means is in said second neutral position, being configured, such that when said lock barrel means is displaced from the inactive configuration to the active configuration, the connector means is induced to displace from said disengagement configuration to said engagement configuration, such that the intermediate engagement means is displaced from said second neutral position to said first engagement position, and said connector retaining means is induced to displace from said non-retaining position to said retaining position;

said connector biassing means biassing said connector means in said disengagement position;

said connector retaining means being disposed such that when the connector retaining means is in said retaining position the connector retaining means retains the connector means in said engagement configuration, and such that when the connector retaining means is in said non-retaining position the connector means is free to return to said disengagement configuration;

said connector means, said door grasping means, said pusher means, and said retractor means being disposed and configured such that:

(A) when said connector means is in said engagement configuration and said door grasp means passes from said first non-working position to said second actuation position the pusher means engages said intermediate engagement means in said first engagement position so as to induce the connector retaining means to be displaced from said retaining position to said non-retaining and so as to induce the intermediate engagement means to displace the retractor means from said first retractor position to said second retractor position, and (B) when said door grasp means passes from said second actuation position to said first non-working position, the pusher means disengages the intermediate engagement means such that said reset biassing means urges said intermediate engagement means to reset to said second neutral position, thereby allowing the retractor means to return to said first retractor position.

5. A door unlocking system as described in claim 4, wherein the connector retaining means comprises a step on the connector means, a guide means, and a biassing means; said step, guide means, and biassing means being disposed such that:

said biassing means gives the connector means such a bias that when the connector means is displaced from said disengagement configuration to said engagement configuration, the step is caused to move under the guide means such that the connector means cannot return to the disengagement configuration; and when said connector means is in said engagement configuration and said door grasp means passes from said first non-working position to said second actuation position the pusher means engages said intermediate engagement means in said first engagement position so as to induce the step to move out from the guide means such that the connector means may return to the disengagement configuration.

6. A door unlocking system as described in claim 4, wherein the function of the connector biassing means is performed by the reset biassing means.

7. A door unlocking system as described in claim 4, wherein said door grasping means is a handle means.

8. The door unlocking system as described in claim 4, wherein the system further comprises:

a releaseable locking means;

said releasable locking means comprising a locked configuration in which said releaseable locking means releasably locks connector means in said engagement configuration and an unlocked configuration in which the connector means is free to return to the disengagement configuration;

said releaseable locking means, said door grasping means, said connector means, and said pusher means being disposed and configured such that (A) when said lock barrel means is in said active configuration and the connector means is inducing displacement of said intermediate engagement means from said second neutral position to said first engagement position, the door grasping means can pass from said first non-working position to said second actuation position such that the pusher means engages said intermediate engagement means and induces said releaseable locking means to be displaced from said unlocked configuration to said locked configuration; and (B) when said intermediate engagement means is releaseably locked in said first engagement position by said releaseable locking means and said lock barrel means changes from said inactive configuration to said active configuration, said connector means is displaced such that said releaseable locking means is induced to be displaced from said locked position to said unlocked position such that said reset biassing means urges said intermediate engagement means to pass to said second neutral position.

9. A door unlocking system for use with a door combination comprising a door, a door enclosure border, and a door locking means, said door locking means comprising a lock barrel means, and a latch bolt means being displaceable between a bolt latched configuration and a bolt released configuration, said door being lockable to said door enclosure border when said latch bolt means is in said bolt latched configuration and said door being released from said door enclosure border when said latch bolt means is in said bolt released configuration, said latch bolt means comprising a bolt biassing means for biassing said latch bolt means in said bolt latched configuration, and said lock barrel means being displaceable between an inactive configuration and an active configuration, said door unlocking system comprising:

retractor means for selectively engaging said latch bolt means, said retractor means being displaceable between a first disengaged position, a second engaged position and a third retracted position, said retractor means being disengaged from said bolt latching means when in said first disengaged position, said retractor means engaging said latch bolt means in said bolt latched configuration when in said second engaged position and in said bolt released configuration when in said third retracted configuration;

retractor biassing means for biassing said retractor means in said first disengaged position;

door grasping means for selectively engaging said retractor means, said door grasping means being displaceable between a first non-working position and a second actuation position, said door grasping means being operatively disengaged from said retractor means when the latter is in said first disengaged position, said door grasping means operatively connecting to said retractor means to displace the latter from said second engaged position to said third retracted position when being displaced form said first non-working position to said second actuation position;

connector means for operatively connecting said lock barrel means to said retractor means, said connector means being displaceable between a retractor non-engaging configuration and a retractor engaging configuration to displace said retractor means from said first disengaged position to said second engaged position when said lock barrel means is being displaced from said inactive configuration to said active configuration;

connector biassing means for biassing said connector means in said retractor non-engaging configuration; and connector retaining means for selectively retaining said connector means in said retractor engaging configuration with said retractor means in said second engaged position, said connector means being released from said connector retaining means and displaced back to said retractor non-engaging configuration by said connector biassing means with said retractor means being displaced from said second engaged position to said third retracted position by said door grasping means;

said retractor biassing means displacing said retractor means back to said first disengaged position with said connector means in said retractor non-engaging configuration when said door grasping means is displaced from said second actuation position to said first non-working position.

10. A door unlocking system as described in claim 9, wherein said lock barrel means includes an unlocking cam rotatably mounted thereon, said unlocking cam being rotatable between a cam inactive position intermediate generally opposed cam active positions and said cam active positions, said unlocking cam being in said cam inactive position and said cam active positions when said lock barrel means is in said inactive configuration and said active configuration, respectively, said connector means being operatively engageable by said unlocking cam from said retractor non-engaging configuration to said retractor engaging configuration when said unlocking cam is displaced form said cam inactive position to either one of said cam active positions, whereby said connector means is operatively engaged by said unlocking cam being rotatably displaced either clockwise or counterclockwise.

11. A door unlocking system as described in claim 9, further comprising a connector releaseable locking means;

said connector releasable locking means including a locked configuration in which said connector releaseable locking means releasably locks said connector means in said retractor engaging configuration, and an unlocked configuration in which said connector means is free to return to said retractor non-engaging configuration under the action of said retractor biassing means;

said connector releaseable locking means, said door grasping means, said connector means, and said retractor means being disposed, configured and sized such that (A) when said lock barrel means is in said active configuration and said connector means is inducing displacement of said retractor means from said first disengaged position to said second engaged position, said door grasping means can pass from said first non-working position to said second actuation position such that said door grasping means operatively engages said retractor means from said second engaged position to said third retracted position and induces said connector releaseable locking means to be displaced from said unlocked configuration to said locked configuration; and (B) when said retractor means is releaseably locked in said second engaged position by said releaseable locking means and said lock barrel means changes from said inactive configuration to said active configuration, said connector means is displaced such that said connector releaseable locking means is induced to be displaced from said locked position to said unlocked position by said connector biassing means such that said retractor biassing means urges said retractor means to return to said first disengaged position.

12. A door unlocking system as described in claim 11, wherein said door grasping means is a handle means.

* * * * *